US008894258B2

(12) United States Patent
Cheng

(10) Patent No.: US 8,894,258 B2
(45) Date of Patent: Nov. 25, 2014

(54) LED OPTICAL ASSEMBLY FOR AUTOMOTIVE HEADLAMP

(75) Inventor: Xinghua Cheng, Tianjin (CN)

(73) Assignee: Tianjin Foncol Science & Technology Development Co., Ltd., Tianjin (CN)

( * ) Notice: Subject to any disclaimer, the term of this patent is extended or adjusted under 35 U.S.C. 154(b) by 286 days.

(21) Appl. No.: 13/557,201

(22) Filed: Jul. 24, 2012

(65) Prior Publication Data

US 2012/0307511 A1 Dec. 6, 2012

(30) Foreign Application Priority Data

Jun. 2, 2011 (CN) ..... 2011 1 0146966
Jun. 2, 2011 (CN) ..... 2011 2 0183147

(51) Int. Cl.
*F21V 7/00* (2006.01)
*F21S 8/10* (2006.01)

(52) U.S. Cl.
CPC ..... *F21S 48/1388* (2013.01); *F21S 48/1154* (2013.01); *F21S 48/1358* (2013.01); *F21S 48/1258* (2013.01)
USPC ..... 362/518; 362/545; 362/549; 362/473; 362/517; 362/368

(58) Field of Classification Search
CPC ..... F21S 48/1154; F21S 48/1388
USPC ..... 362/545, 473, 549, 543, 544, 800, 518, 362/517, 368, 240, 247, 241
See application file for complete search history.

(56) References Cited

U.S. PATENT DOCUMENTS

| | | | | |
|---|---|---|---|---|
| 2002/0093820 | A1 * | 7/2002 | Pederson | 362/241 |
| 2007/0025117 | A1 * | 2/2007 | Watanabe et al. | 362/545 |
| 2009/0027909 | A1 * | 1/2009 | Albou | 362/517 |
| 2009/0231876 | A1 * | 9/2009 | Nakamura et al. | 362/545 |
| 2011/0051440 | A1 * | 3/2011 | Sumada et al. | 362/473 |
| 2012/0201043 | A1 * | 8/2012 | DiPenti et al. | 362/545 |

* cited by examiner

*Primary Examiner* — Britt D Hanley
*Assistant Examiner* — Kevin Quarterman
(74) *Attorney, Agent, or Firm* — Matthias Scholl P.C.; Matthias Scholl

(57) ABSTRACT

An LED optical assembly for automotive low-beam headlamps, including: a lens, a lens frame, a light source frame assembly, and an LED light source. The lens includes a main lens and a plurality of reflectors. The main lens is located in the front of the LED optical assembly and the reflectors are scattered therearound. At one side of the main lens, four sets of the reflectors, which are symmetrical in shape, are respectively disposed at the left part and the right part thereof, and in a back of the main lens, six sets of the reflectors, which are symmetrical in shape, are respectively disposed at the left part and the right part thereof.

7 Claims, 28 Drawing Sheets

LED OPTICAL ASSEMBLY FOR AUTOMOTIVE HEADLAMP

CROSS-REFERENCE TO RELATED APPLICATIONS

This application is a continuation-in-part of International Patent Application No. PCT/CN2011/076926 with an international filing date of Jul. 6, 2011, designating the United States, now pending, and further claims priority benefits to Chinese Patent Application No. 201120183147.0 filed Jun. 2, 2011, and to Chinese Patent Application No. 201110146966.2 filed Jun. 2, 2011. The contents of all of the aforementioned applications, including any intervening amendments thereto, are incorporated herein by reference.

CORRESPONDENCE ADDRESS

Inquiries from the public to applicants or assignees concerning this document should be directed to: MATTHIAS SCHOLL P. C., ATTN.: DR. MATTHIAS SCHOLL ESQ., 14781 MEMORIAL DRIVE, SUITE 1319, HOUSTON, TX 77079.

BACKGROUND OF THE INVENTION

1. Field of the Invention

The invention relates to an automotive lighting system, and more particularly to an LED optical assembly for automotive low-beam headlamps.

2. Description of the Related Art

High power white LEDs have developed so rapidly over recent years that effective and energy-conscious LED illumination technology becomes more and more mature. Many industrial players initiated their research in respect of application concerning high power white LEDs in automotive lamps and sophisticated products have also been released. LED automotive lamps are not only energy-efficient but also diverse and stylish in terms of outer appearance. Headlamps must be safe while illuminating the road ahead. Many countries impose harsh restrictions upon low-beam headlamps that are required to have clear cut-off lines so as to prevent drivers from being glazed by the lights coming from opposite cars. As for traditional automotive headlamps, most of them adopt a simple reflector or a reflector teamed up with a light blocker and a delineascope containing a collector lens in the front to fulfill such requirement of cut-off lines. Both methods mentioned above can only use the lights that are directed to the reflector from the light source and the remaining lights must be blocked or diffused to eliminate possible hazards, which results in low utilization efficiency of lights. The light utilization efficiency of the former is 40% more or less and the latter impossible to exceed 60%. From this point of view, the optical design involving automotive low-beam headlamps is a key and tough issue for automobile headlamps. Thought some prestigious lighting facilities manufacturers have released several LED automotive headlamps for certain high-end limousines, the light utilization efficiency still has sufficient room for improvement as those products adopt traditional optical forms. Comparing with traditional light source in terms of light output, current white LEDs used for illumination are not up to the standard. Under such circumstance, more LEDs have to be used to compensate such shortcomings, thus directly causing the risk of overheat. In order to effectively disperse excessive heat, extra cost is incurred, which makes it difficult for the LED lamps to popularize. Besides what is mentioned before, if continued to use traditional optical design, the puzzle of low light utilization efficiency might come out. The traditional automotive low-beam headlamp with cut-off lines adopting LED as light source chiefly consists of a lens, a frame assembly, and LED illuminating chips. The lens has a non-rotational and non-spherical curve surface and is composed of several lenses each of which also has a non-rotational and non-spherical curve surface and faces towards different directions. Those lenses are connected with each other to from the lens. A main lens is located in the front and auxiliary lenses surround it. According to this approach, although the main lens and auxiliary lenses use all the lights emitted by the light source and a section of straight light area with cut-off lines is formed without blocking any light, the light area formed by the main lens direct toward right front and on the other hand, the lights from those auxiliary lenses direct toward different directions. Therefore, reflectors are needed to reflect those lights from the auxiliary lenses to the right front, thus increasing both volume and cost of automotive lamps. As described above, the light output of a single LED is rather limited, more than one set of light source and reflectors must be put together to meet illumination requirements. Nevertheless, it seems rather difficult for a tiny automotive lamp to hold so many optical assemblies.

SUMMARY OF THE INVENTION

In view of the above-described problems, it is one objective of the invention to provide an LED optical assembly applied to automotive low-beam headlamps. Direct lights emitted from the light source form a light area with cut-off lines via a main lens and meanwhile, the remaining lateral lights are also directed to the main lens through the first and second reflection by primary and secondary reflectors. It is unnecessary to configure a light-blocking unit between the reflectors and the main lens, and lateral lights also can form a light area with cut-off lines.

To achieve the above objective, in accordance with one embodiment of the invention, there is provided an LED optical assembly for automotive low-beam headlamps, comprising: a lens, a lens frame, a light source frame assembly, and an LED light source. The lens comprises a main lens and a plurality of reflectors, and the main lens is located in the front of the LED optical assembly and the reflectors scattered therearound. At one side of the main lens, four sets of the reflectors which are symmetrical in shape are respectively disposed at a left part and a right part, and in a back of the main lens, six sets of the reflectors which are symmetrical in shape are respectively disposed at a left part and a right part.

In a class of this embodiment, a measurement value range of each point on the curved surface of the main lens at three coordinates (X, Y, and Z) is below: assume the central point of the lens is the origin of the coordinate system, the coordinate area along X is (5 mm, +35 mm), along Y (−20 mm, +20 mm), and along Z (−15 m, +15 mm).

In a class of this embodiment, 3 sets of the reflectors are placed on either side of the light source central point along Y in the back of the lens. Each set contains at least one reflector and those total 6 sets of reflectors are arranged in a line. Two sets of reflectors that are the closest to the light source central point constitute primary reflectors and face towards the main lens ahead. The distance between the inner-most border of the 2 sets of primary reflectors and the border of the light source is ranged from 0 mm to 2 mm. 2 sets of secondary reflectors are deployed respectively in the left and right adjacent to the outmost border of the 2 sets of primary reflectors along Y and less close to the light source central point. Each of the 2 sets of secondary reflectors in the left orientates towards lower left and upper left and in the right, lower right and upper right. Those 6 sets of reflectors are all in the shape of free-form surface. The entire length range of each 3 sets of reflectors in either left or right along Y is 1 mm-20 mm. Each reflector set respectively makes up of 5%-80% of the length. The size range of each reflector set along X is 1 mm-10 mm and along Z, 1 mm-10 mm. There are 4 sets of primary reflectors configured by the side of the lens in the upper left and lower left, upper right and lower right. Each set contains at least one reflector. The primary reflector in the upper left is in relation to the secondary reflector facing towards upper left, the primary reflector in the lower left in relation to the secondary reflector facing towards lower left, the primary reflector in the upper right in relation to the secondary reflector facing towards upper right and the primary reflector in the lower right in relation to the secondary reflector facing towards lower right. The surface of each reflector comprising the 4 sets of reflectors is in the shape of ellipsoid or in other similar shapes. One focus of each ellipsoid surface falls in a radical range of 0 mm-5 mm around the light source central point and the other, a range of 0 mm-5 mm along X in front of the secondary reflector to which each ellipsoid surface refers. The length of the long axis of each ellipsoid surface ranges between 1 mm and 35 mm and the short axis 1 mm and 30 mm.

In a class of this embodiment, the lens frame comprises an upper part and a lower part. The internal profile of the frame matches the external profile of the lens, so does the back shape of the frame and the light source frame assembly. The lens frame has radiation wings attached to its outside.

In a class of this embodiment, the LED light source is an upper light source or a mixed light source comprising both upper and lower light sources. The upper light source is a high-and-low-beam light source and the lower light source, a high beam light source.

In a class of this embodiment, the LED illuminating chips of the upper and lower light sources of the mixed light source are respectively located in one side of a basic plate and the upper and lower light sources are situated in either side of the basic plate containing the LED illuminating chips.

In a class of this embodiment, the light source frame assembly comprises a light source frame and a circuit board. An installation chute for the LED light source is opened in the center of the light source frame assembly. A circuit board setup chute and a lead hole are disposed in the perimeter of the installation chute; in the center of the circuit board is opened a light source positioning chute; 2 electrodes are respectively configured in the left and right of the light source positioning chute; another 4 electrodes are situated elsewhere on the circuit board, and correspond to connect with the electrodes of the light source positioning chute.

Advantages of the invention are summarized below. Via the main lens, the LED optical assembly forms a section of straight light area with cut-off lines and without obvious dispersion in the front. Lateral lights are collected by the reflectors and then reflected to the main lens. Since there is no any light blocker set between the reflectors and the lens, the light utilization efficiency is considerably improved and the lateral lights are used to support to form the aforesaid light area. The volume of the optical assembly is considerably reduced as there is no need to add external reflectors. Several the components can be placed inside the automotive lamp so as to simplify its structure and reduce cost. The component is able to rationally allocate and utilize all the lights emitted by the LED light source within the scope of 360°×180°. Putting aside approx. 25% absorbed by the lens and reflectors, nearly 75% of the lights are available for the automotive headlamp to distribute. Significantly improving the light utilization efficiency, the component also makes it relatively easier for the optical designer to design cut-off lines so as to simplifying the development process of low-beam headlamps. As the lens frame is able to radiate the heat generated by the LED light source well, no extra radiators are required being installed.

DETAILED DESCRIPTION OF THE EMBODIMENTS

For further illustrating the invention, experiments detailing an LED optical assembly for automotive low-beam headlamps are described below. It should be noted that the following examples are intended to describe and not to limit the invention.

Figure 3:
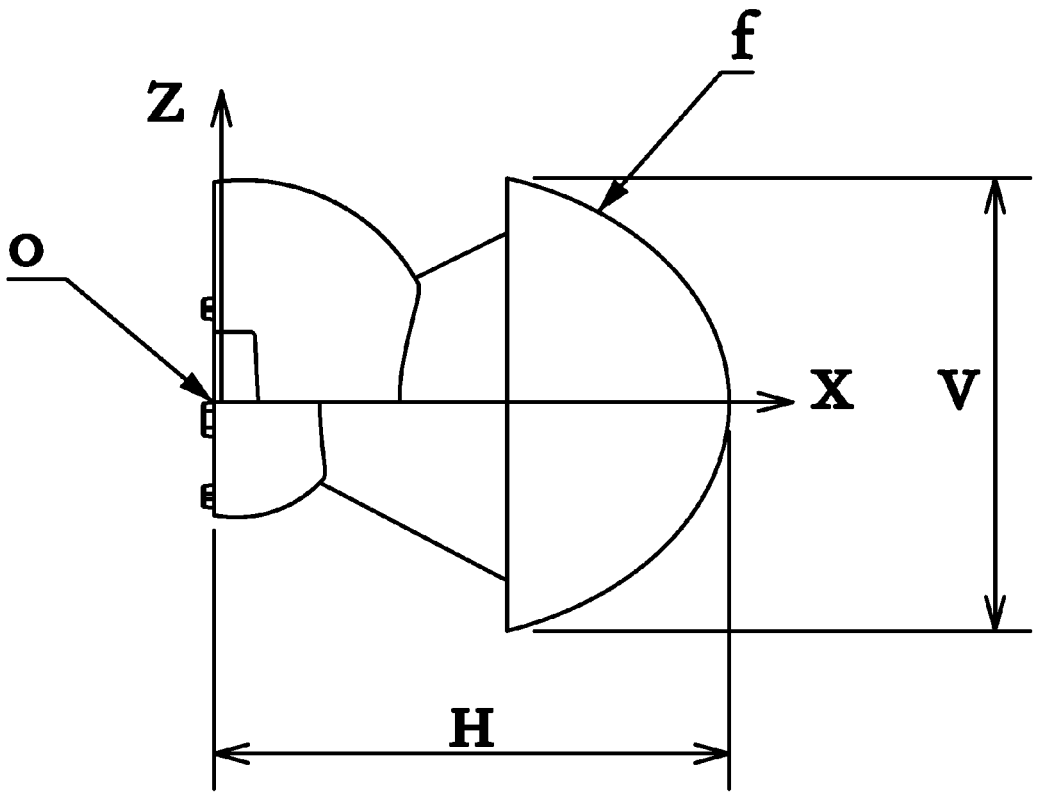
FIG. 3 is a left side view depicting the structure of a lens of the invention.
Figure 4:
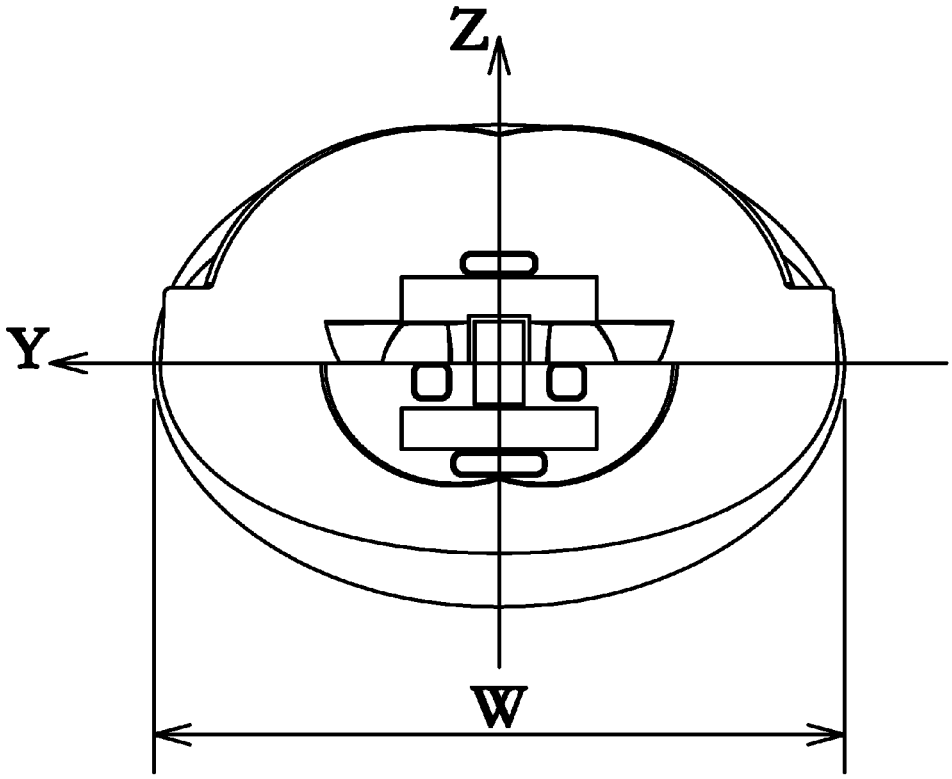
FIG. 4 is a rear view depicting the structure of a lens of the invention.

Referring to the drawings attached hereto, an LED optical assembly of an automotive lamp mainly comprises a lens 1, a lens frame 2, a LED light source 3, a light source frame assembly 4, and other supporting parts like electrodes 5 and screws 6 and so on. As for the structure of the assembly, please refer to FIGS. 1 and 2. Referring to FIG. 3, a main lens f which has non-rotational and non-spherical curved surfaces is positioned in front of the lens. The design principles and method of the main lens are the same as those disclosed by the prior art. When the refractive index of lens material stands between 1.4-2.4 as shown in FIGS. 3 and 4, the measurement value range of each point on the curved surface of the main lens fat the 3 coordinates (X, Y, and Z) is below: assume the central point O of the lens is the origin of the coordinate system, the coordinate area H along X is (5 mm, +35 mm), W along Y is (−20 mm, +20 mm), and V along Z is (−15 m, +15 mm).

Figure 5:
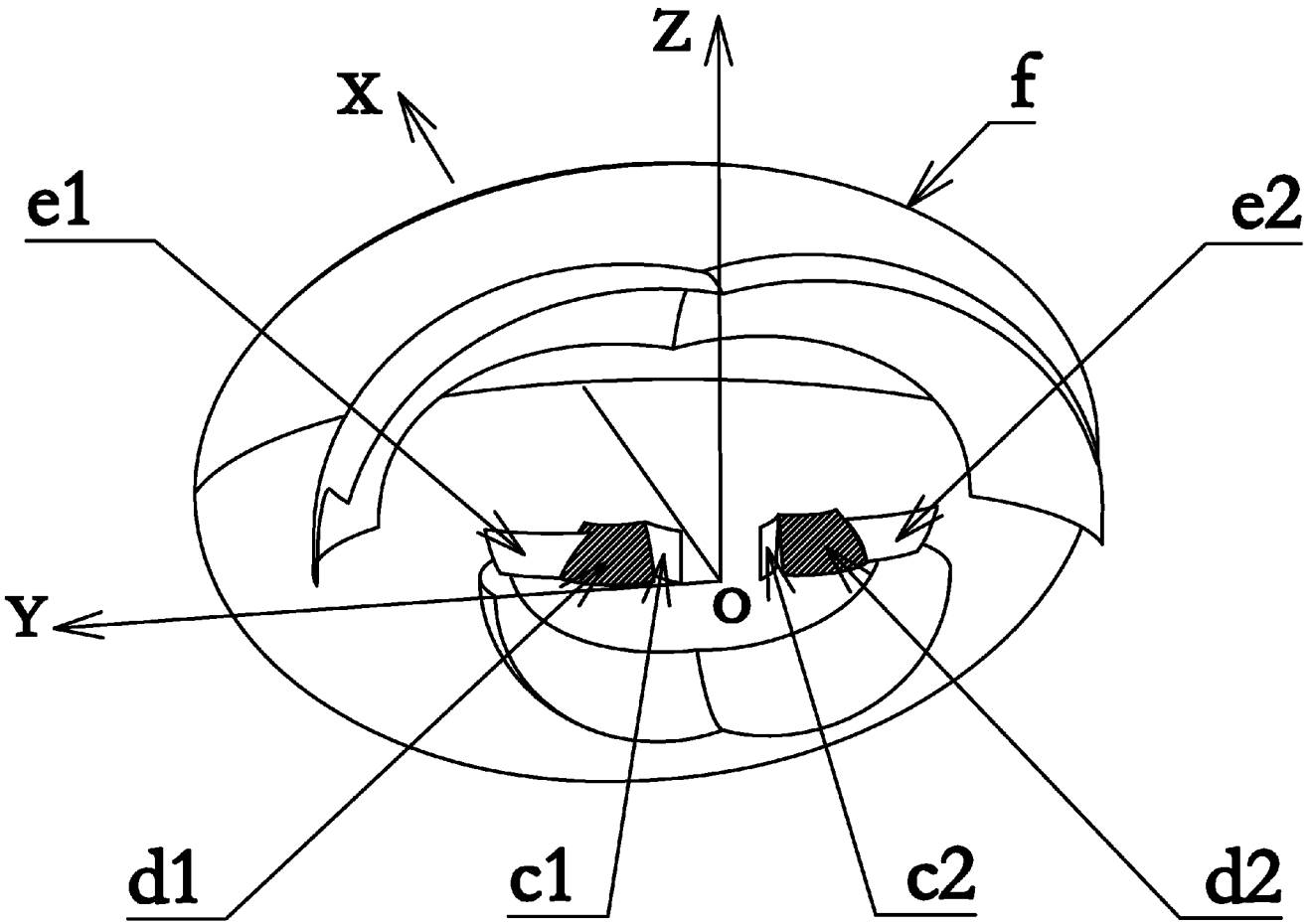
FIG. 5 is a relative positional view of a reflector in the back of a lens and peripheral optical assemblies of the invention.
Figure 6:
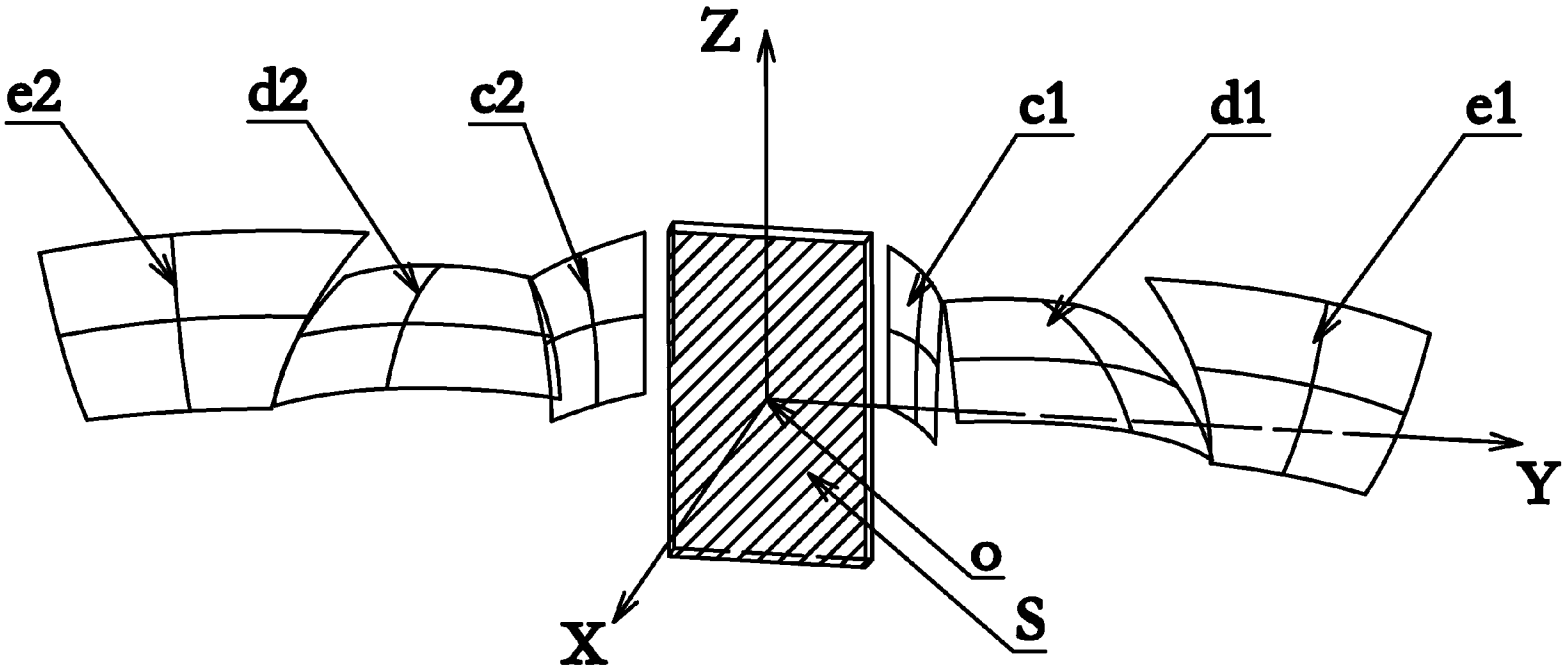
FIG. 6 is a three-dimensional perspective view of a reflector in the back of a lens of the invention.
Figure 7:
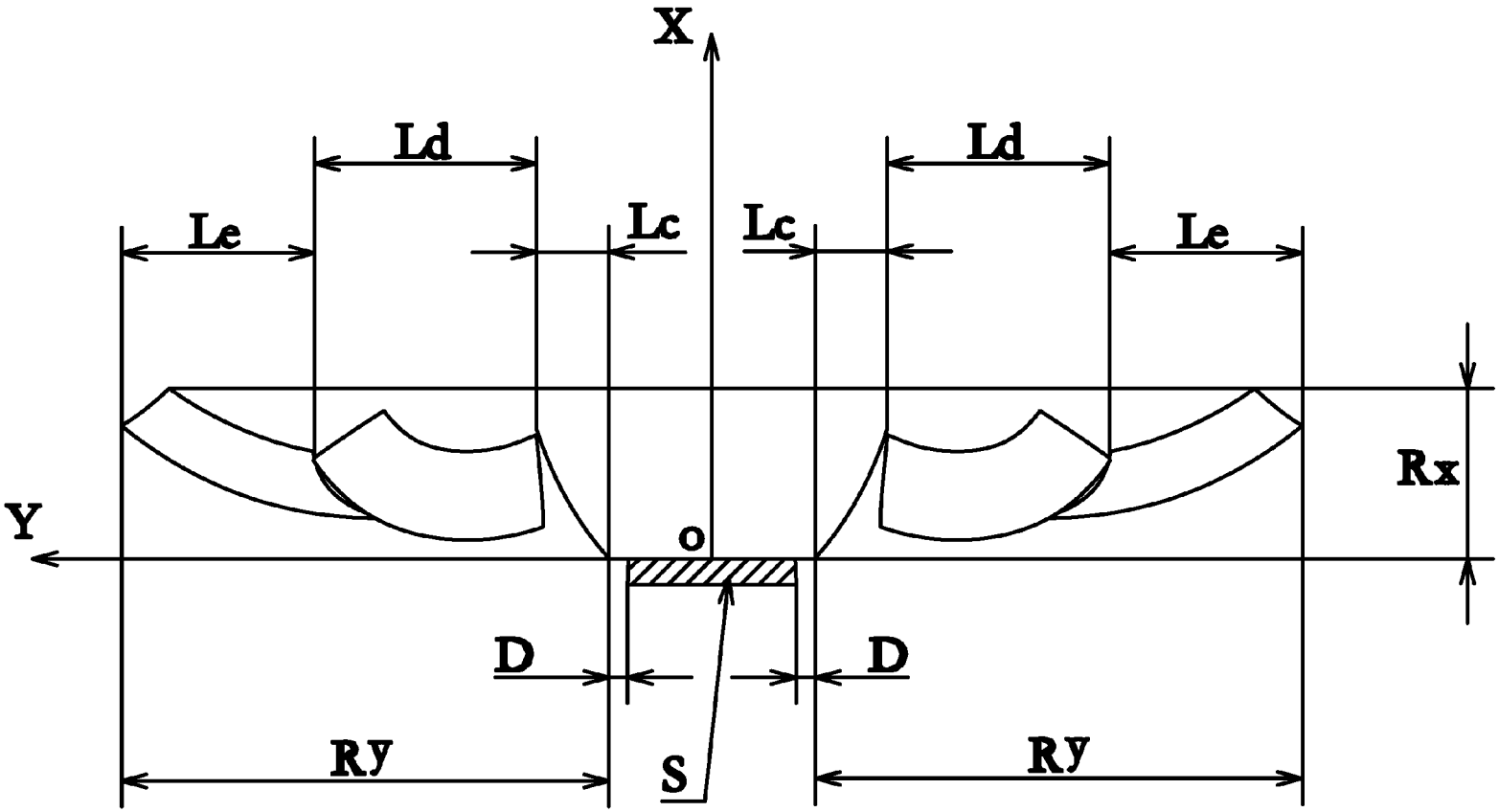
FIG. 7 is a top view depicting dimensions of a reflector in the back of a lens of the invention.
Figure 8:
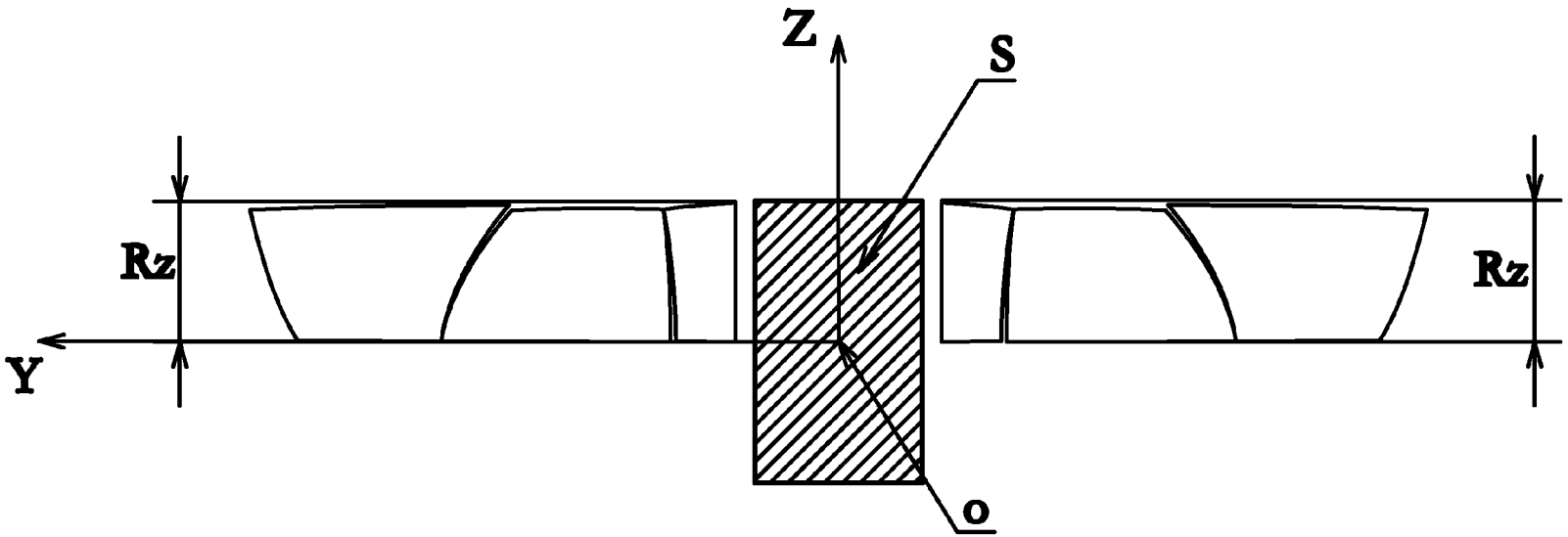
FIG. 8 is a rear view depicting dimensions of a reflector in the back of a lens of the invention.

Set up 3 sets of reflectors on either side of the light source central point 0 along Y in the back of the lens and those total 6 sets of reflectors are arranged in a line. Each set contains at least one reflector. The example in question configures one reflector for each set, i.e. c1, d1, e1 and c2, d2 and e2, and their positional relation with the lens is shown in FIGS. 5 and 6. Two sets of reflectors c1 and c2 that are the closest to the light source central point O (or light source S) constitute the primary reflectors and face towards the main lens ahead. The distance between the inner-most border of the 2 sets of primary reflectors and the border of the light source S is D as shown in FIG. 7 and ranged from 0 mm to 2 mm. 2 sets of secondary reflectors are deployed respectively in the left and right adjacent to the outmost border of the 2 sets of primary reflectors c1 and c2 along Y and less close to the light source central point. Each of the 2 sets of secondary reflectors d1 and e1 in the left orientates towards lower left and upper left and d2 and e2 in the right lower right and upper right. Those 6 sets of reflectors are all in the shape of free-form surface. The entire length range Ry of 3 sets of reflectors in both left and right along Y is 1 mm-20 mm, where the length of each set of reflectors Lc, Ld, and Le respectively makes up of 5%-80% of Ry. The size range of each reflector set along X is 1 mm-10 mm and as for their size range along Z, i.e. Rz, please refer to FIG. 8. The value range of Rz is 1 mm-10 mm. Each surface is coated with reflection material to form reflectors.

Figure 9:
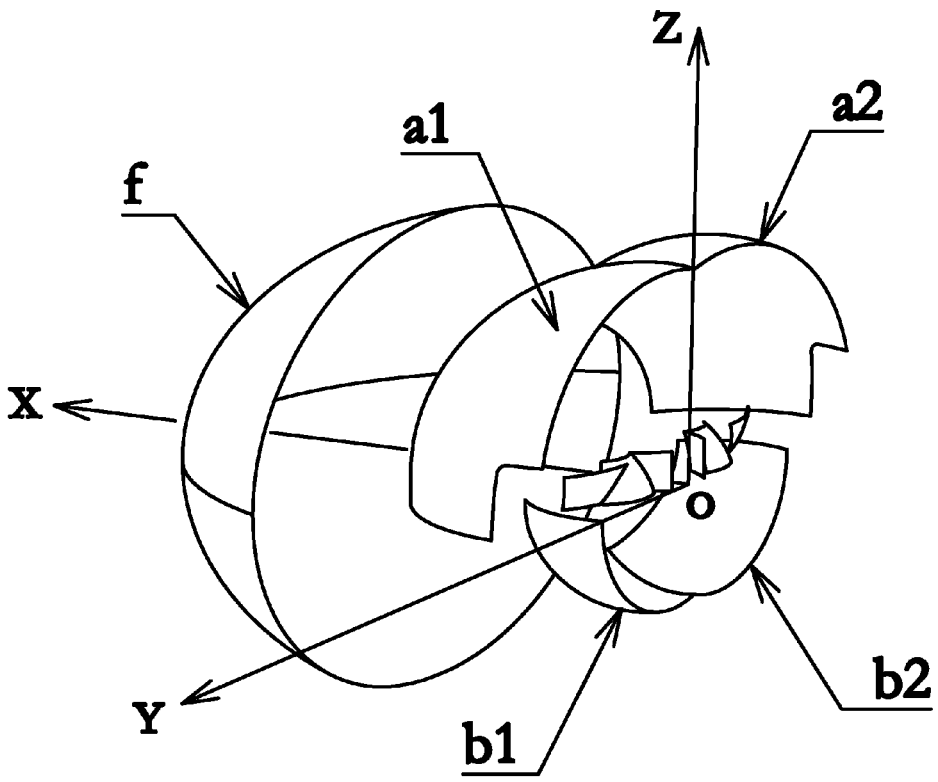
FIG. 9 is a relative positional view of a reflector by the side of a lens and peripheral optical assemblies of the invention.
Figure 10:
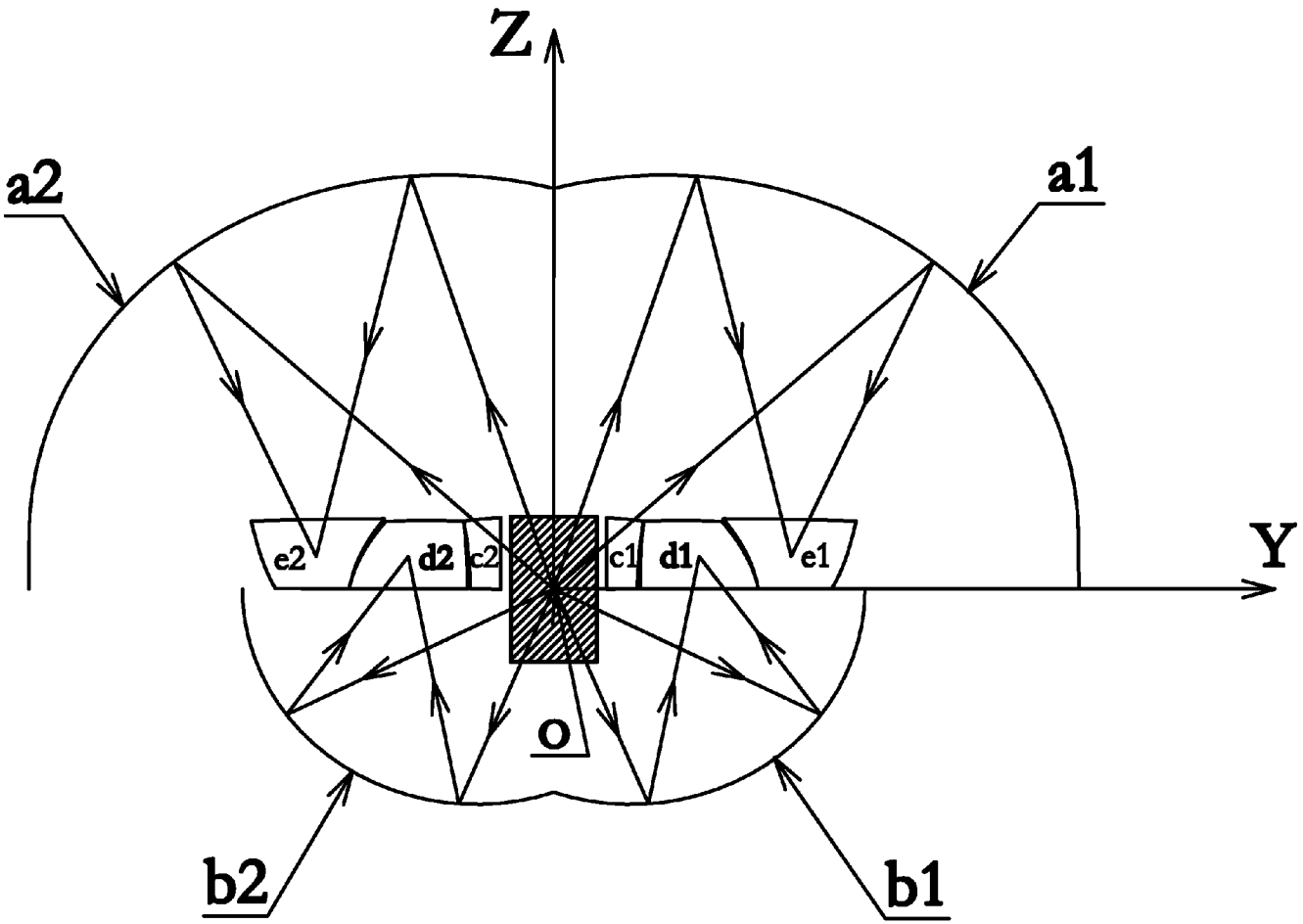
FIG. 10 is a relative relational view of reflectors respectively by the side of and in the back of a lens of the invention.

Set up 4 sets of primary reflectors by the side of the lens and there are a1 in the upper left, b1 lower left, a2 upper right, and b2 lower right, as shown in FIG. 9. Each set contains at least one reflector. The example in question configures one reflector for each set and those 4 sets of primary reflectors correspond respectively to each of 4 sets of secondary reflectors in the back of the lens as shown in FIG. 10, i.e. the primary reflector a1 in the upper left is in relation to the secondary reflector e1 facing towards upper left, b1 to d1, a2 to e2, and b2 to d2.

The surface of each reflector comprising the 4 sets of reflectors is in the shape of ellipsoid or in other similar shapes. One focus of each ellipsoid surface falls in a radical range of 0 mm-5 mm around the light source central point 0 and the other, range of 0 mm-5 mm along X in front of the secondary reflector to which each ellipsoid surface refers. The length of the long axis of each ellipsoid surface ranges between 1 mm and 35 mm and the short axis 1 mm and 30 mm. Each surface is coated with reflection material to form reflectors.

Figure 1:
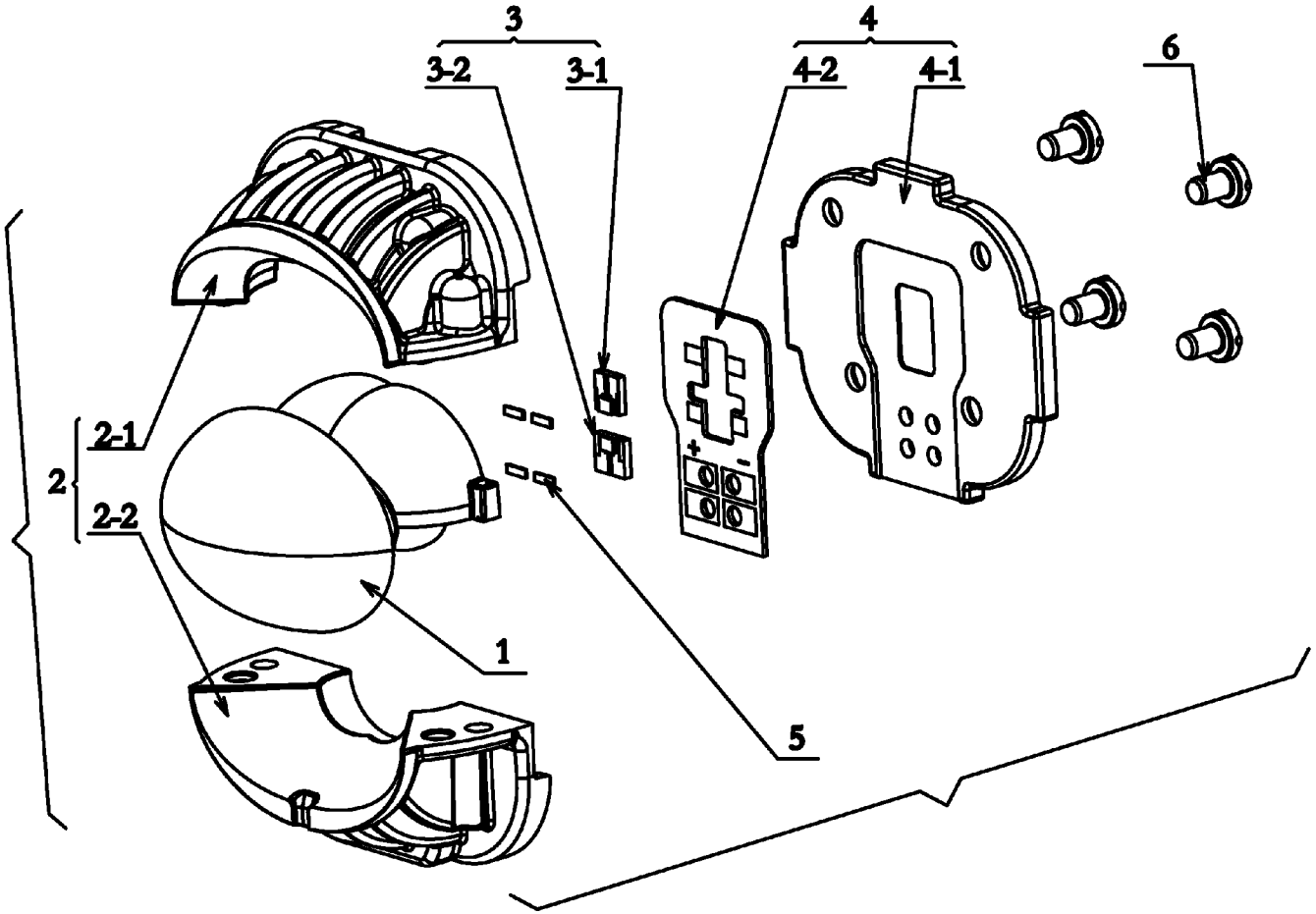
FIG. 1 is a structural view of an LED optical assembly for automotive low-beam headlamps.

The lens frame comprises an upper part and a lower part, i.e. 2-1 and 2-2 as specified in FIG. 1. The internal profile of the frame matches the external profile of the lens, so does the back shape of the frame and the light source frame assembly 4. The lens frame 2 possesses outstanding heat conductivity and has radiation wings attached to its outside. Together with the light source frame assembly 4, it constitutes the radiation unit and profile of the LED optical assembly. The heat generated by the LED light source is emitted in turn via the light source frame assembly 4 and the lens frame 2.

Figure 11:
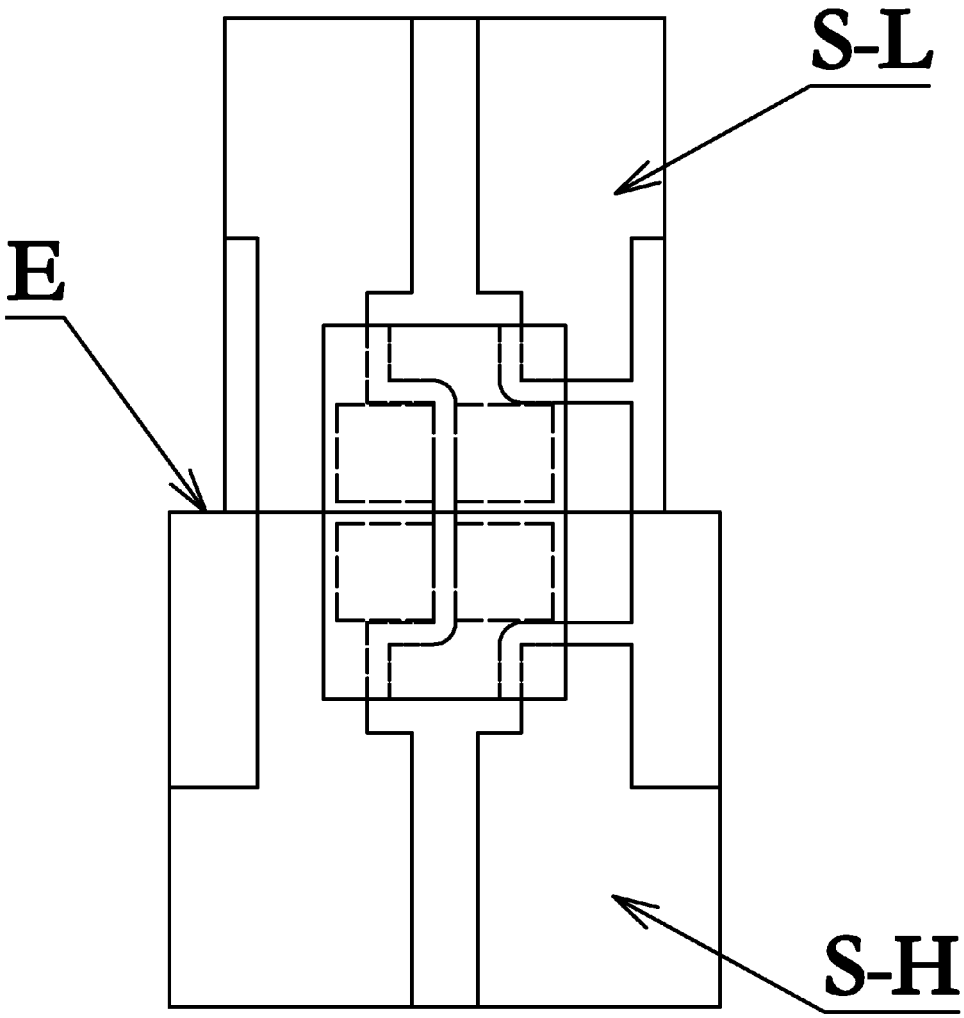
FIG. 11 is a structural and configuration positional view of the compound LED light source of the invention.

The LED light source is an upper light source or a light source mixed by both upper and lower light sources. Referring to FIG. 11, the upper light source S-L is a high-and-low-beam light source and the lower light source S-H a high beam light source. When low-beam illumination is required, light up the upper light source and high beam illumination, the light source combining both upper and lower light sources. Should the system is merely applied to low-beam illumination, only the upper light source S-L is needed.

Figure 12:
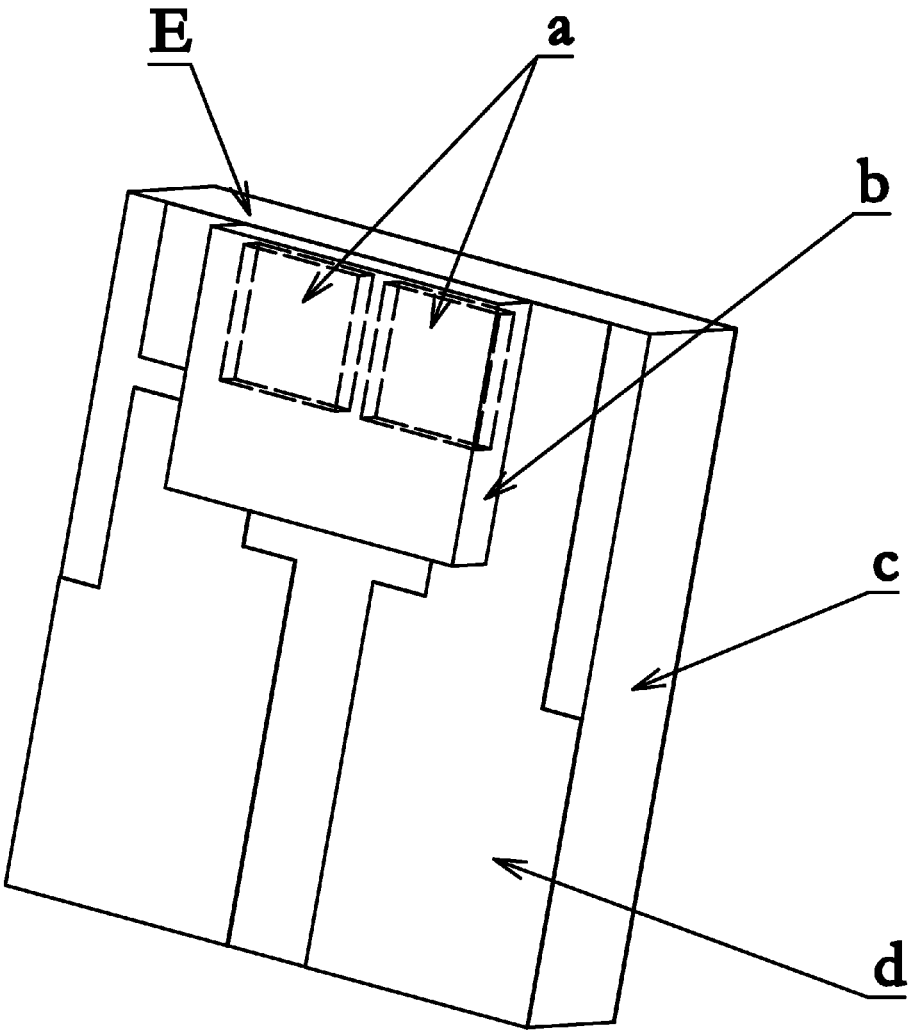
FIG. 12 is a three-dimensional perspective view of a single LED formed light source of the invention.
Figure 13:
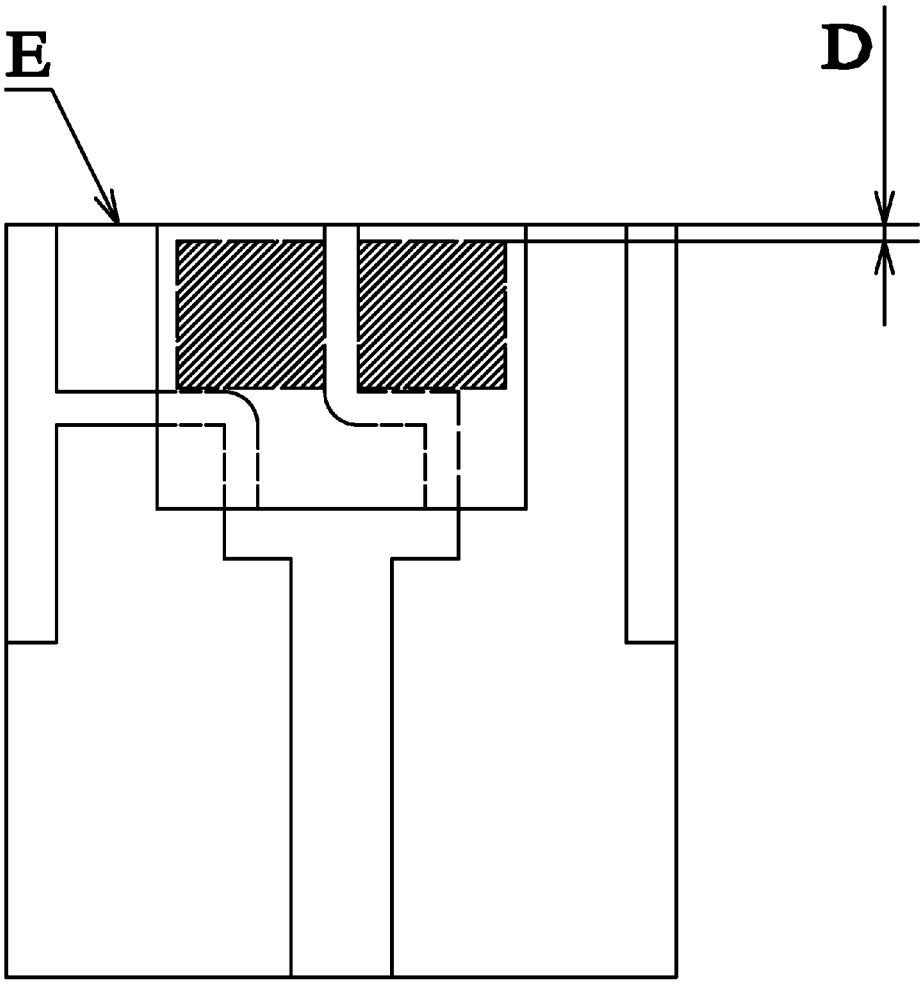
FIG. 13 is a configuration positional view of an LED light source chip of the invention.

For the independent structure of the upper and lower light sources, please refer to FIG. 12. In the figure, c is a light source basic plate on which there is a circuit d containing a LED illuminating chip a. In order to form a mixed light source, the LED illuminating chip is placed alongside one edge of the basic plate and D (ranged from 0.005 mm to 0.4 mm) specified in FIG. 13 is the distance between them. Around the LED illuminating chip a protection material b is wrapped and as for the relative position concerning the mixed light source, please refer to FIG. 11. The upper light source S-L and lower light source S-H are located close to the edge E.

Figure 2:
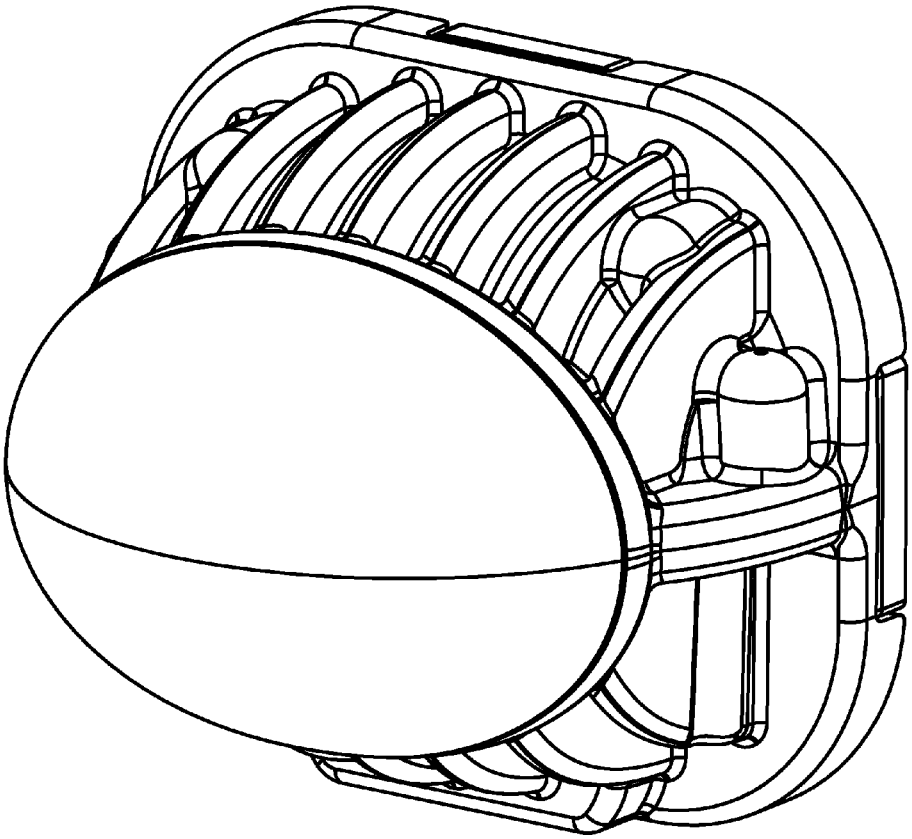
FIG. 2 is a three-dimensional perspective view of an LED optical assembly for automotive low-beam headlamps.
Figure 14:
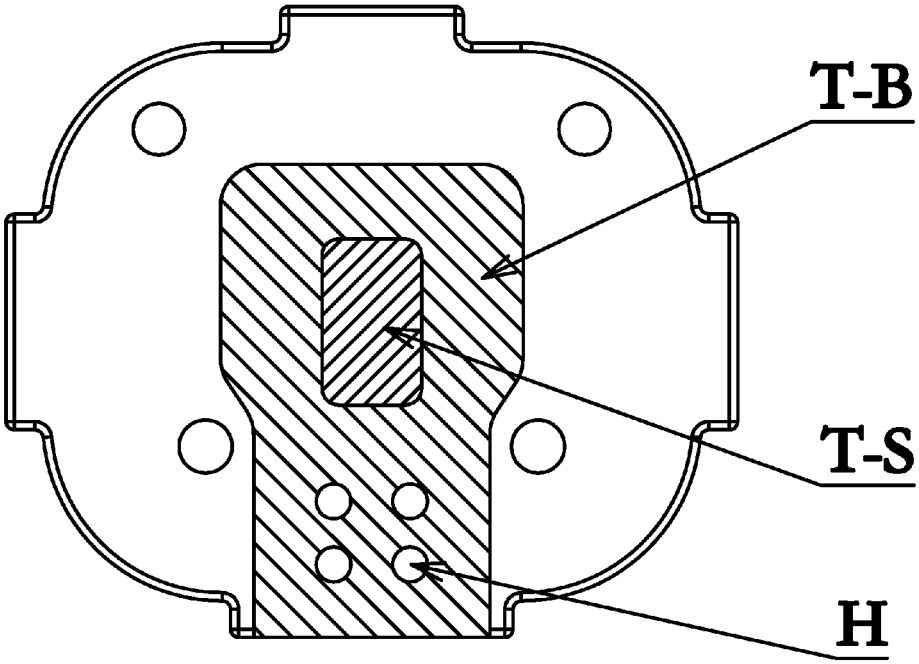
FIG. 14 is a front view of a light source frame formed by an LED light source frame assembly of the invention.
Figure 15:
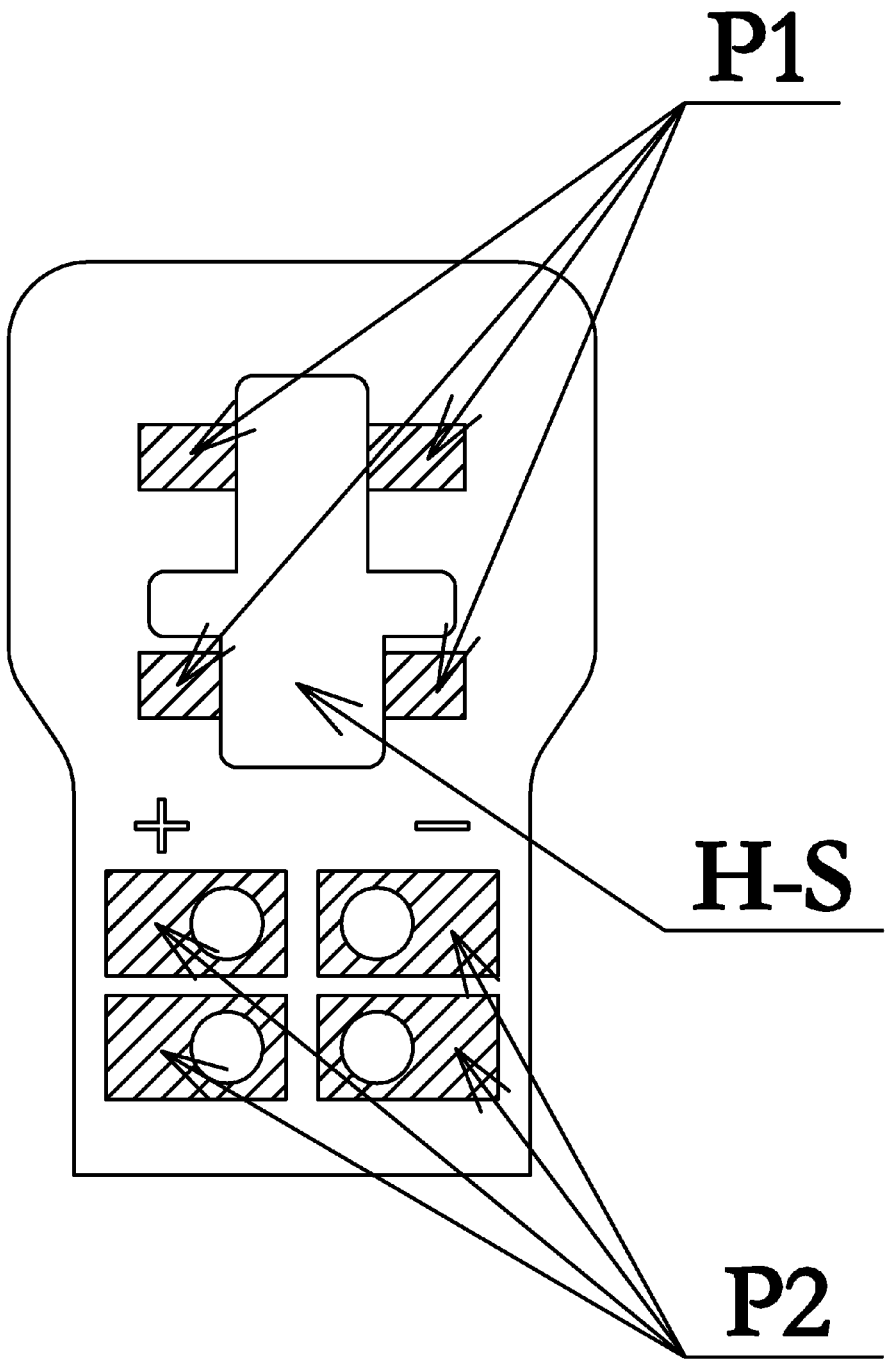
FIG. 15 is a front view of a circuit board in connection with an LED light source frame assembly of the invention.

As shown in FIG. 2, the light source frame assembly comprises a light source frame 4-1 and a circuit board 4-2. In respect of the structure of the light source frame, please refer to FIG. 14. An installation chute T-S for the LED light source is opened in the center and in the perimeter of the installation chute there is a circuit board setup chute T-B and a lead hole H. FIG. 15 shows the circuit board around whose center a light source positioning chute H-S is opened. Corresponding and connected to the 4 electrodes P2 situated elsewhere on the circuit board, 2 electrodes P1 are respectively configured in the left and right of the light source positioning chute.

I. System Optical Principles

Figure 16:
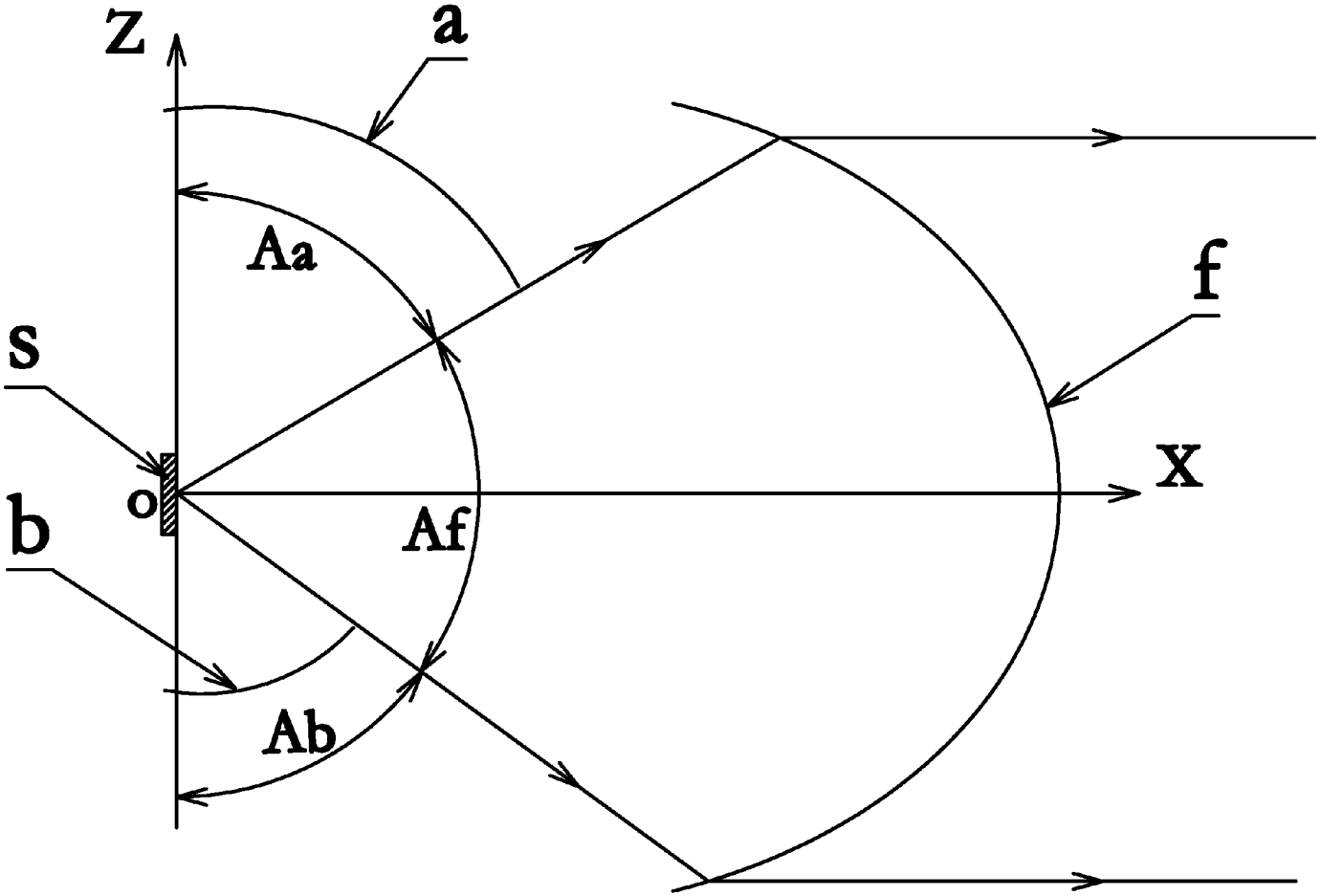
FIG. 16 is a side view of zoning light source lights of the invention.

1. The Optical Principles Concerning the System are as Follows:

The system classifies all the lights emitted by the light source into two categories: one is direct lights sent to the main lens f in the right front from the light source as shown in the area Af in FIG. 16 and the other the remaining lateral lights. Different control approaches are adopted by the system in respect of those categories:

1) Direct Lights of the Light Source:

As the design principles and method involving the main lens refer to a kind for automotive low-beam headlamp with cut-off lines that uses LED as a light source, the direct lights from the light source turn into a section of straight light area with cut-off lines without obvious dispersion after being refracted by the main lens.

Figure 17:
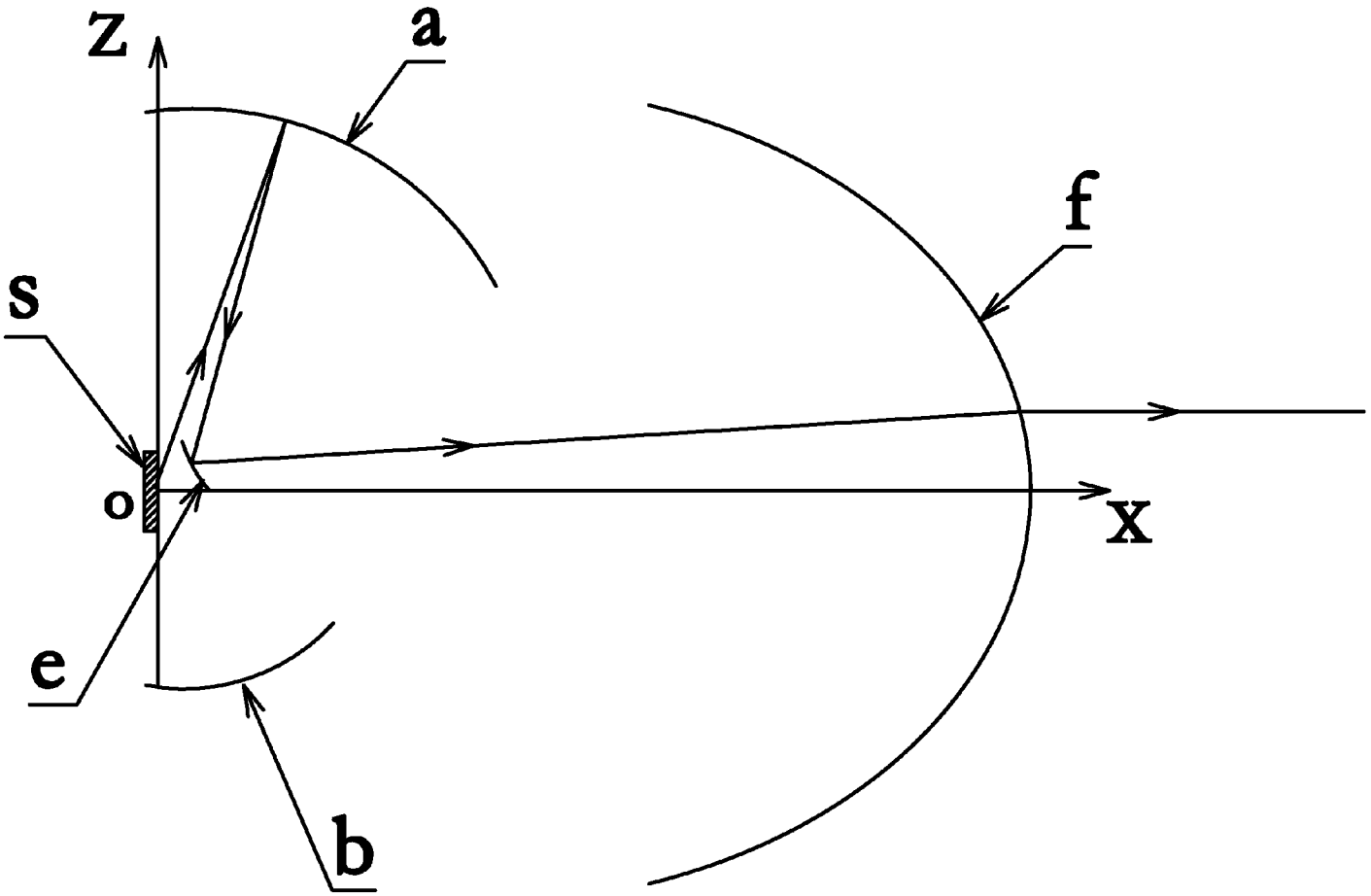
FIG. 17 shows the control principles in respect of upper lights by the side of a light source of the invention.
Figure 18:
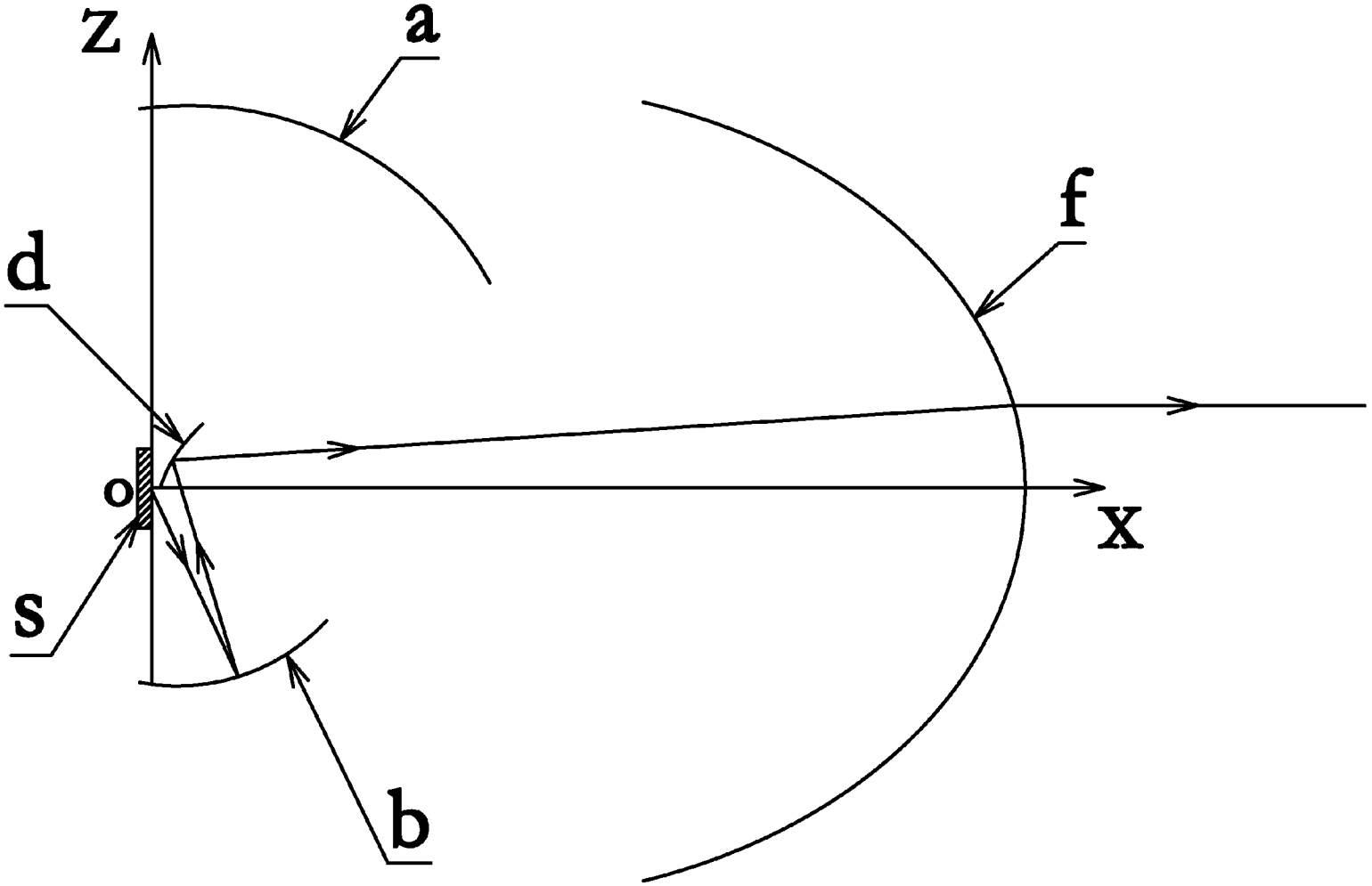
FIG. 18 shows the control principles in respect of lower lights by the side of a light source of the invention.
Figure 19:
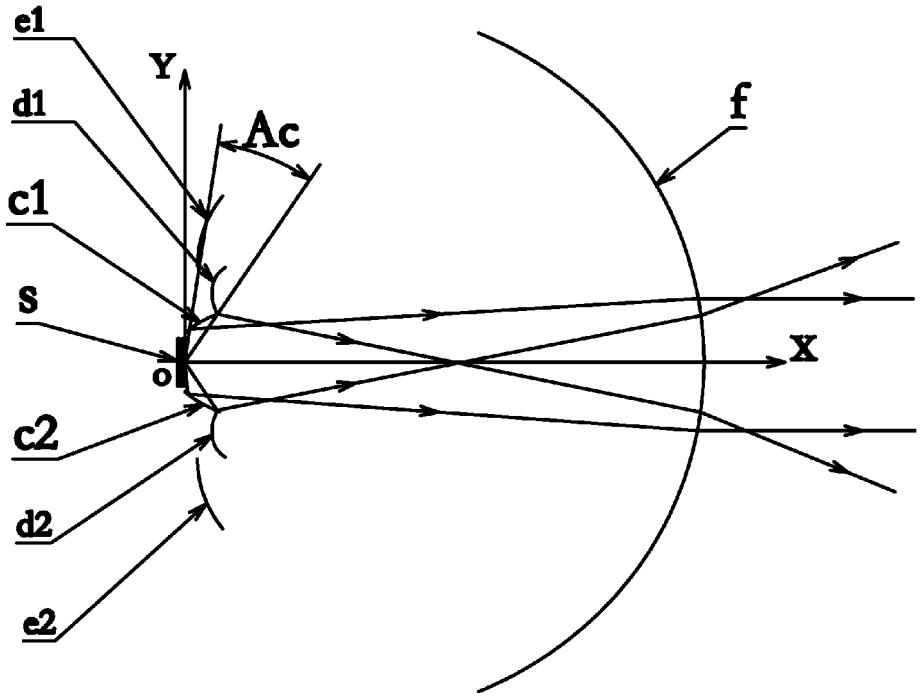
FIG. 19 shows the control zones and principles in respect of lights by either side of a light source of the invention.
Figure 20:
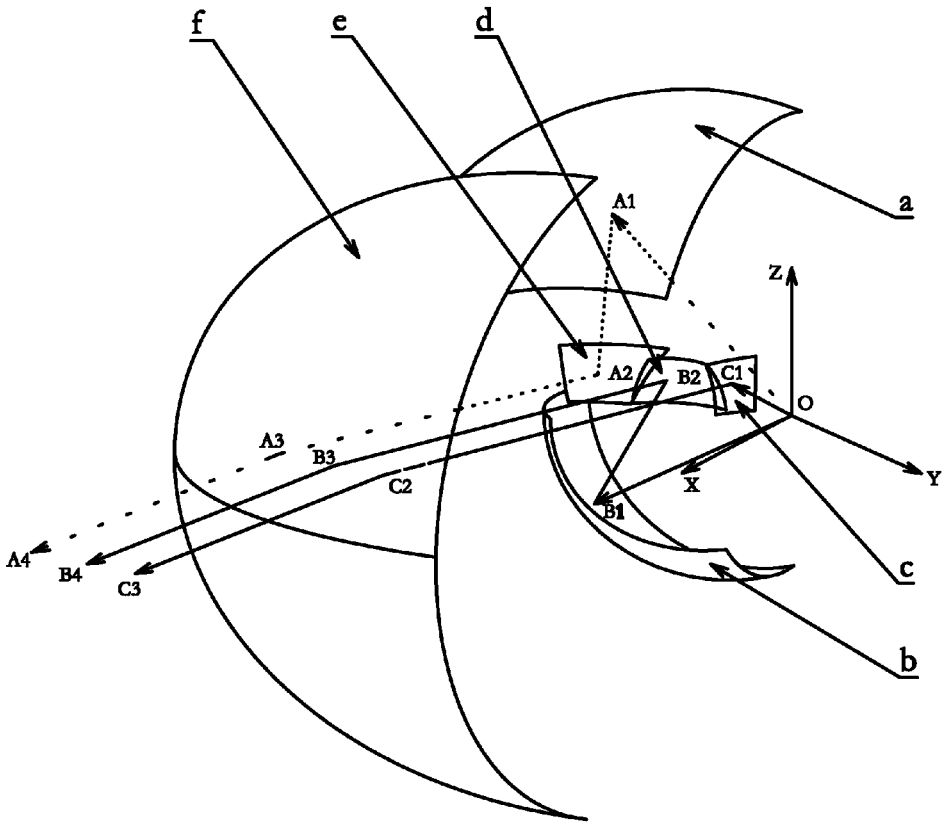
FIG. 20 is a three-dimensional perspective view of ray tracing in connection with primary and secondary reflected lights of the invention.
Figure 21:
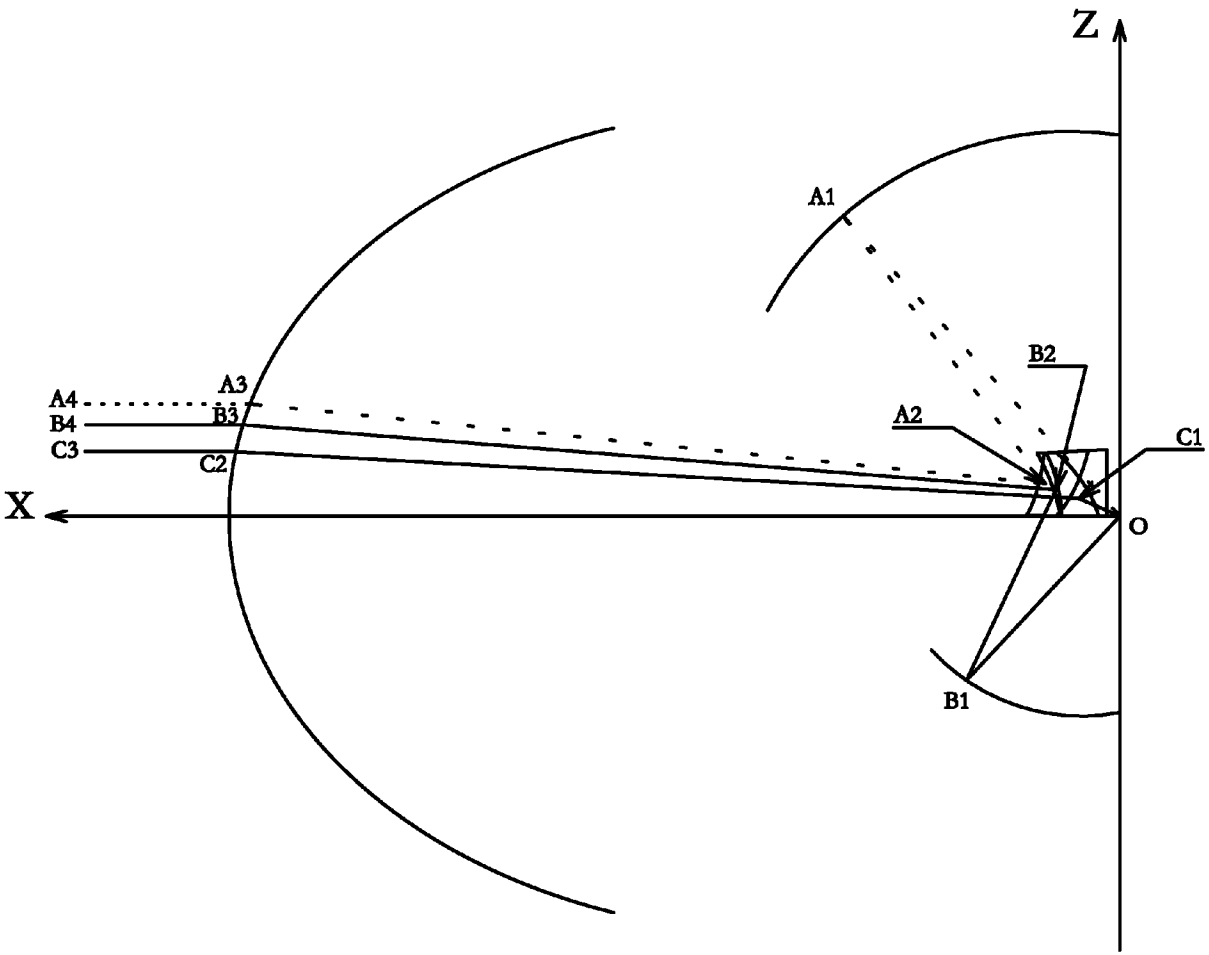
FIG. 21 is a side view of ray tracing in connection with primary and secondary reflected lights of the invention.

2) Lateral Lights of the Light Source:

The lateral lights from the light source are also classified into 3 categories for the purpose of control: the first is the lights directed to the primary reflector a in the lateral upper left and lateral upper right as shown in the area Aa in FIG. 16 and then to the secondary reflector e following the first reflection as shown in FIG. 17 and finally to the main lens f following the second reflection so as to help to form a section of direct straight light area with cut-off lines without obvious dispersion and the second, the lights directed to the primary reflector b in the lateral lower left and lateral lower right as shown in the area Ab in FIG. 16 and then to the secondary reflector d following the first reflection as shown in FIG. 18 and finally to the main lens f following the second reflection so as to help to form a section of direct straight light area with cut-off lines without obvious dispersion and the third, the rights directed to the reflectors c1 and c2 in the lateral left and right as shown in the area Ac in FIG. 19 and then to the main lens f following reflection by the reflectors c1 and c2 so as to help to form a section of direct straight light area with cut-off lines without obvious dispersion. As for the control of the aforesaid 3 categories, the light path is described specifically below: Referring to FIGS. 20 and 21, the lateral lights OC1 sent by the light source O shine on the primary reflector c in both left and right to turn into the reflected lights C1C2 that subsequently change into the lights C2C3 after being refracted by the main lens f so as to assist to form a section of straight light area with cut-off lines without obvious dispersion. The lateral lights OA1 from the light source O shine upwards on the ellipsoid surface a of the primary reflector. As the light source O is a focus of the ellipsoid surface a or located in the proximity of the focus, the reflected lights A1A2 converge at the other focus of the ellipsoid surface a or nearby, i.e. the reflected lights concentrate in the front of the corresponding secondary reflector e and then are reflected by the reflector to form the reflected lights A2A3 that are ultimately refracted by the main lens f to produce the reflect lights A3A4 so as to assist to form a section of straight light area with cut-off lines without obvious dispersion. Similarly, the lateral lights OB1 sent by the light source O shine downwards on the ellipsoid surface b of the primary reflector. As the light source O is a focus of the ellipsoid surface b or located in the proximity of the focus, the reflected lights B1B2 converge at the other focus of the ellipsoid surface b or nearby, i.e. the reflected lights concentrate in the front of the corresponding secondary reflector d and then are reflected by the reflector to form the reflected lights B2B3 that are ultimately refracted by the main lens f to produce the reflect lights B3B4 so as to assist to form a section of straight light area with cut-off lines without obvious dispersion Via classifying all the lights emitted by the light source and then controlling them through the approaches mentioned before, the system ultimately forms a section of straight light area with cut-off lines without obvious dispersion and effectively utilizes lights in each direction without causing any waste due to deliberately blocking lights or unable to freely control them.

Figure 25:
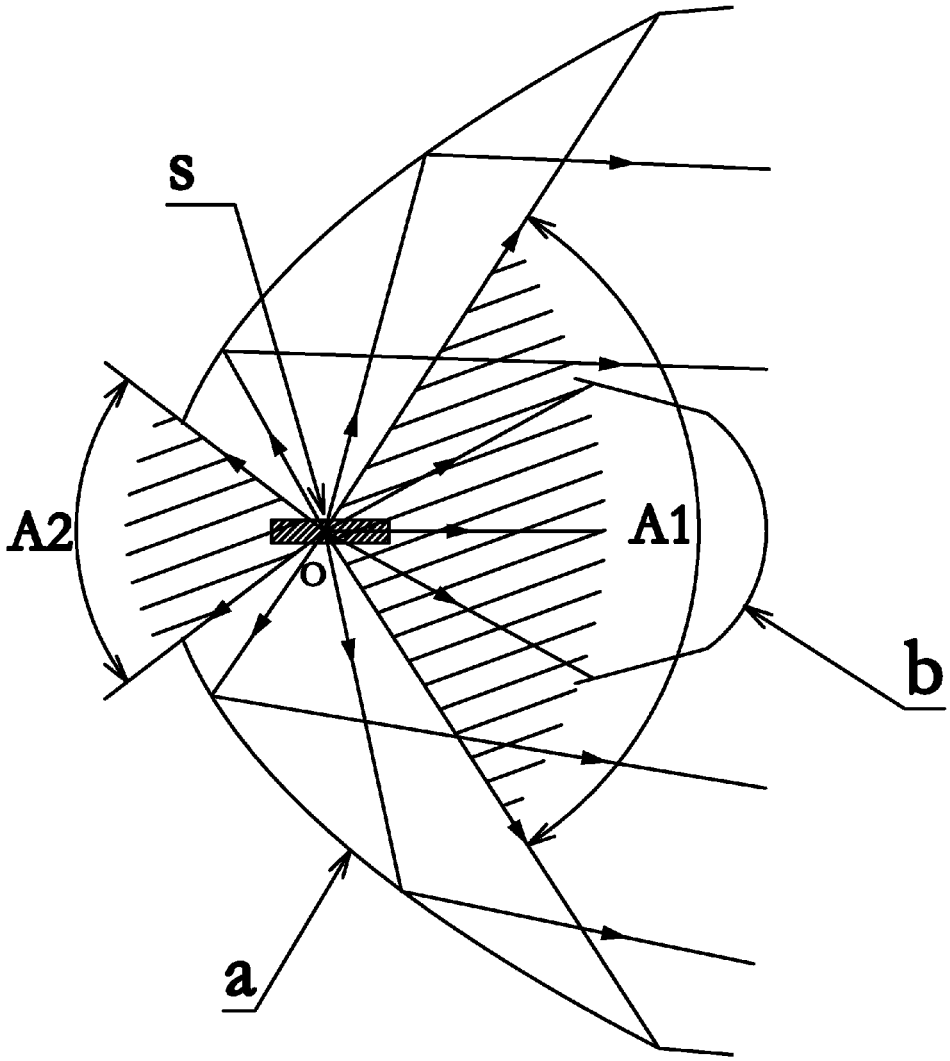
FIG. 25 (Prior art)
FIG. 25 shows the optical principles as regards lamps in the form of a single-reflector used by conventional automobiles.
Figure 26:
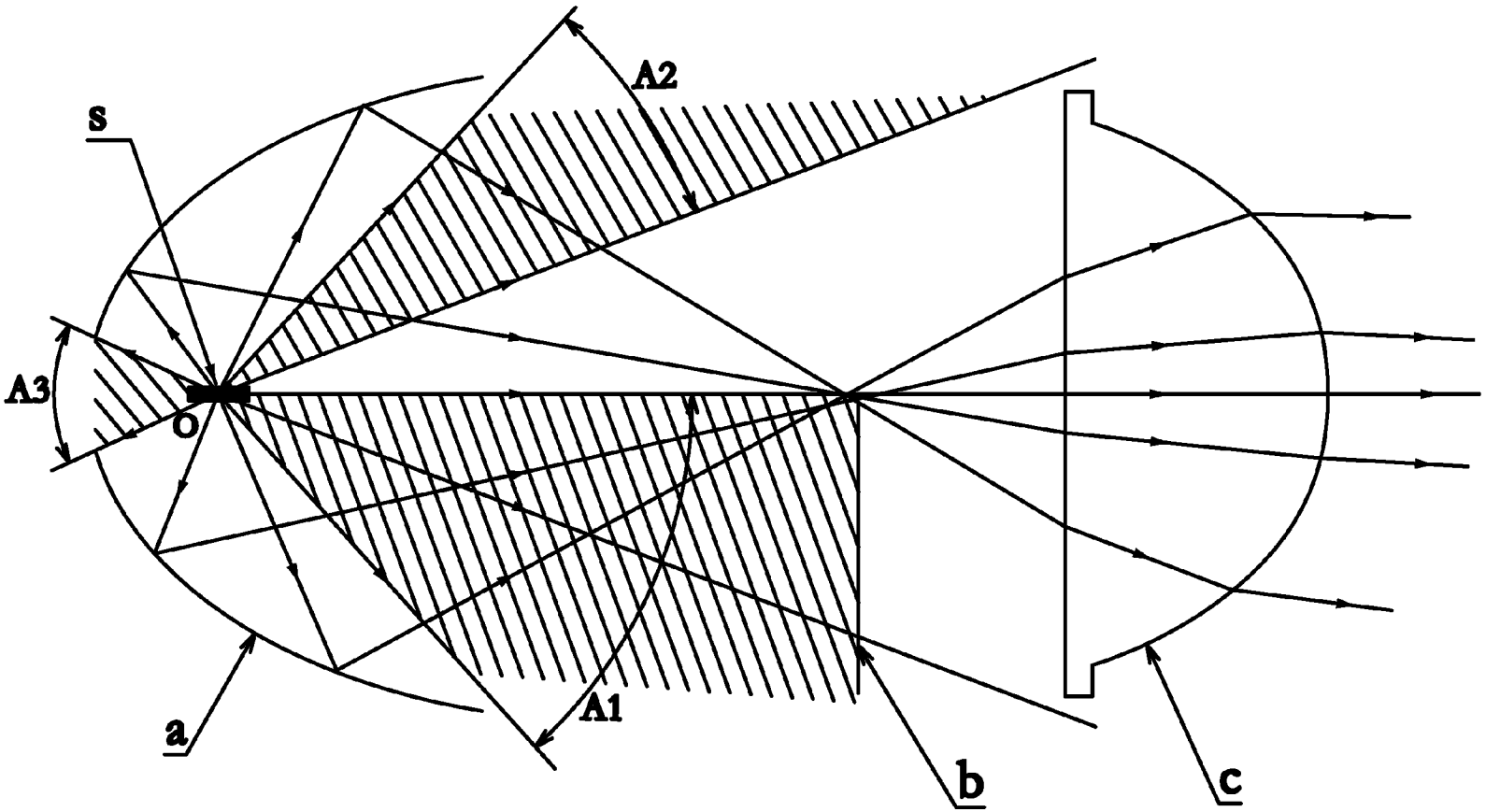
FIG. 26 (Prior art)
FIG. 26 shows the optical principles as regards lamps in the form of delineascope used by conventional automobiles.
Figure 27:
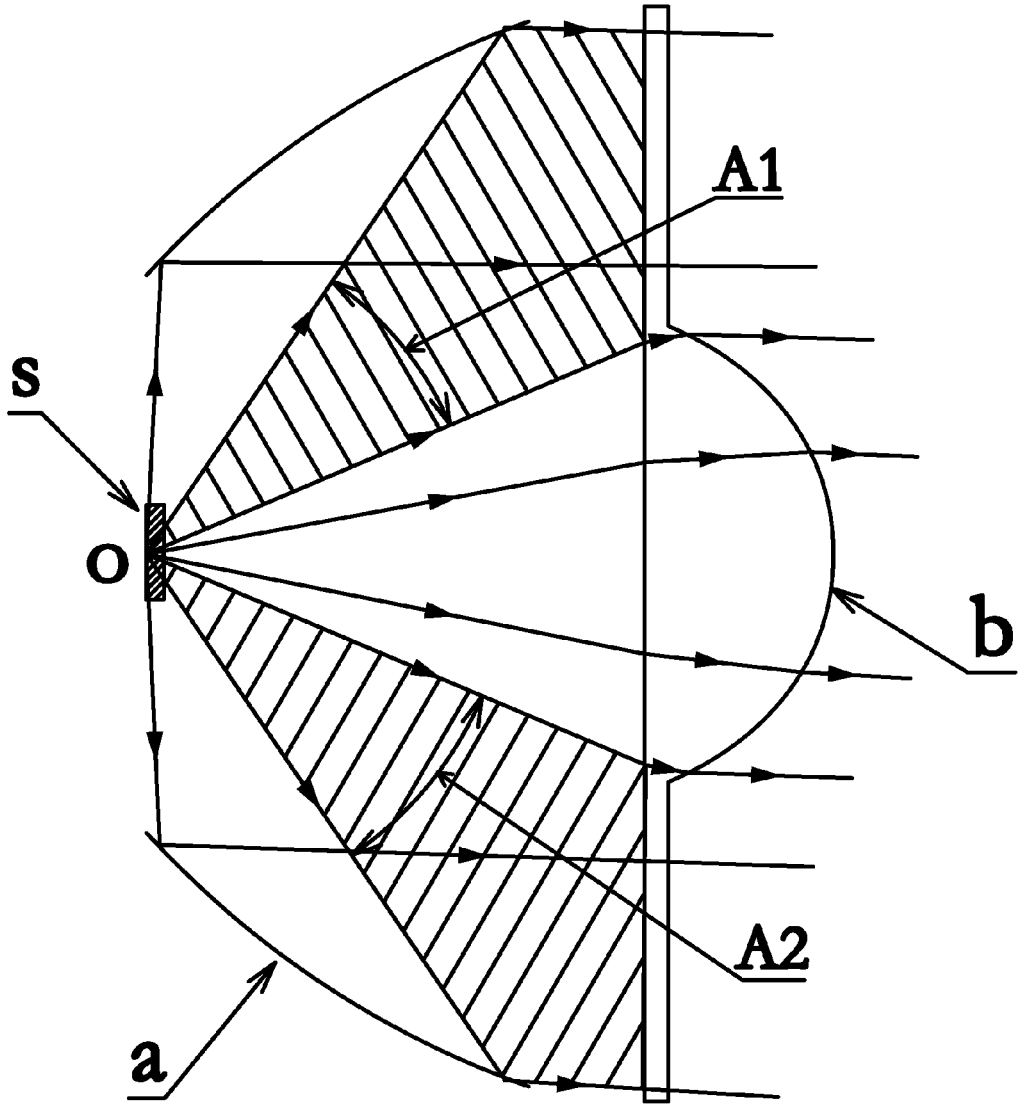
FIG. 27 (Prior art)
FIG. 27 shows the optical principles as regards LED automotive lamps in the lens and reflector combined form used by conventional automobiles.

2. Difference from Other Automotive Optical Lamps with Cut-Off Lines:

Several optical forms predominantly accepted by automotive headlamps at present are as follows:

i) Single Reflector:

As shown in FIG. 25, a reflector a is set up by the side of the light source s and the system only reflects the lateral lights to satisfy light distribution requirements. As lights are reflected once, lights in other directions, for example, the front lights as shown in the area A1 and rear lights in the area A2, cannot be utilized. Moreover, the front lights that are not used have to be blocked by b to eliminate related risks.

ii) Reflector Teamed Up with a Light Blocker and a Delineascope Containing a Collector Lens in the Front:

As shown in FIG. 26, a reflector a is set up by the side of the light source s. To form clear cut-off lines, a light blocker b is positioned in front of the reflector. In addition, unblocked lights are focused by a collector lens e before the light blocker. Like the form described above, the system only reflects the lateral lights and is unable to utilize the lights in the areas A1, A2 and A3. There are three steps of reflection once, blocking once and refraction once constituting the entire light control process.

iii) Lens Plus Reflector:

This is the latest form for current automotive LED headlamps. As shown in FIG. 27, a reflector a is added to the lateral back of the main lens b. The reflector divides all the lights generated by the light source into 2 parts: one part is direct lights that are refracted by the main lens b to directly form required light area and the other part, lateral lights that are reflected once to meet related light distribution requirements. However, the system is also unable to take care of the lights leaked from the areas A1 and A2 between the main lens b and reflector a.

It is revealed by the aforesaid comparison that the main optical forms currently available for automotive headlamps are failed to utilize lights to certain degree. If still adopted those optical forms described above, the LED automotive headlamps inevitably possess those shortcomings.

II. System Description:

The optical principles of the system reveal that the optical control unit of the LED optical assembly of the automotive headlamp should comprise the following 2 independent optical subsystems: 1. A main lens is configured in the front of the system; 2. Reflectors that can do primary and secondary reflections are configured in the lateral back of the system. This example simplifies product structure by integrating the main lens and the reflectors together to form an independent compound lens component. The reflectors are brought into being by coating reflection materials to related positions of the compound lens. Another example of this system is to separate the main lens from the reflectors so as to form 2 independent components that can be assembled to form the LED optical assembly of the automotive headlamps.

1. Lens

1) Structure of the Lens:

In order to make the left of the light area symmetrical to the right, the lens adopted by this example is also left-right symmetrical in terms of structure and overall shape that, however, can be adjusted according to the outline of the light area. As for the outer appearance of the 4 sets of primary reflectors along the lateral direction, ellipsoid surface is employed by this example and other similar curved surfaces like high-order curved surface or free-form surface etc. are optional. Although each primary reflector set mentioned above contains only 1 reflector, multiple reflectors can be set up in compliance with related demands provided that each of them corresponds to one secondary reflector. To satisfy the requirement of the LED light source in various forms, this example has a rectangular light source chute g opened in the central area in the back of the lens. The LED light source can be put into the chute as shown in the shady section on FIG. 28. The chute can also be removed or modified as the case may be and the light source is then located outside the range of the lens.

Figure 28:
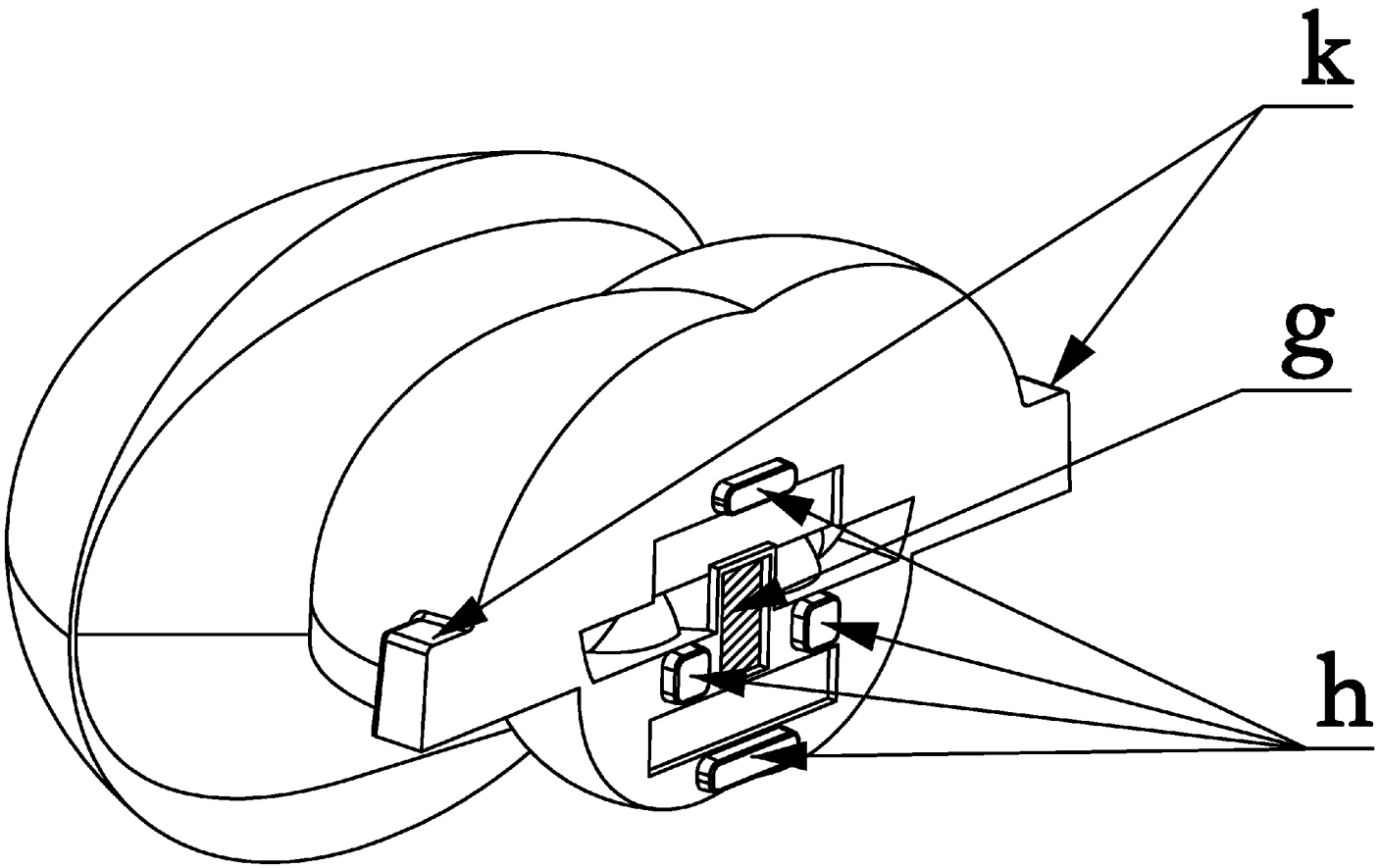
FIG. 28 is a three-dimensional perspective view of a light source chute in the back of the lens and its positioning unit of the invention.

2) Positioning of the Lens:

As shown in FIG. 28, to ensure positioning accuracy of the lens and the light source, this example places several restricting columns h in the back of the lens to position the light source frame assembly and at the same time, to ensure positioning accuracy of the lens and the lens frame, this example sets positioning pins k in the light-free spot of the primary reflector's ellipsoid surface by the side of the lens.

2. Radiation System:

As the LED light source generates a great amount of heat while working, excellent heat radiation is critical to the system that manages heat in the method described below:

1) Primary Heat Radiation Through the Light Source Frame:

The LED light source basic plate and the light source frame as well of this example are made out of materials that conduct heat well. As a result, the heat generated by the LED chip can be transferred to the light source frame effectively which fully covers all the area in the back of the lens that can be utilized so as to expand radiation area. This is the primary heat radiation of the system.

2) Secondary Heat Radiation Through the Lens Frame:

As the lens frame of this example is also made out of materials with excellent heat conductivity and remains in good contact with the light source frame, the heat of the light source frame can be effectively passed to the lens frame that fully covers all the area by the side of the lens that can be utilized so as to expand radiation area. Meanwhile, several radiation wings are also attached to the outside of the lens frame. This is the secondary heat radiation of the system.

3) Heat Radiation Through External Radiators:

Except for the bottom containing wires, the remaining area in the back of the light source frame assembly is smooth and free from any obstacle and can be used to install radiators to further radiate system heat.

3. LED Light Source:

The LED light source basic plate circuit of this example has 2 LED illuminating chips connected in series. How many chips the circuit carries is primarily determined by the required light output and the size of the chip and the main lens. The larger the main lens is, the more chips can be connected. Located in the central area along one edge of the basic plate, 2 LED illuminating chips of this example are arranged in a line. Chips are divided into 2 rows or more according to chip size and quantity. The distance between the chip and the edge of the basic place can be adjusted in line with production technical capability. Protection material is packaged outside the LED light source chip of this example in the shape of rectangle or others. In addition, any other approach that is feasible can also be deployed to protect the LED light source chip.

Figure 22:
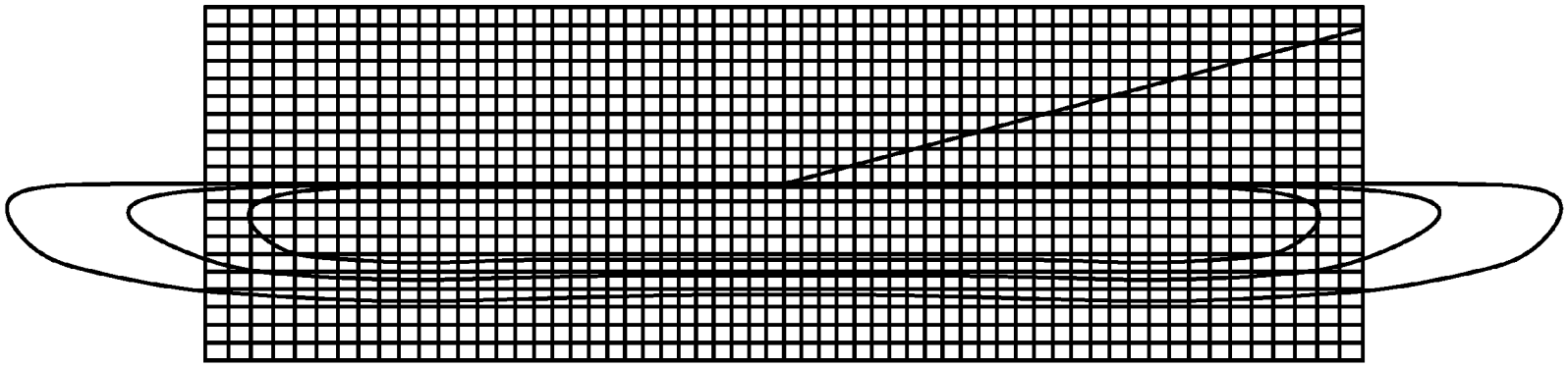
FIG. 22 shows the shape of light areas generated by a high-low-beam light source spot lamp of the invention.
Figure 23:
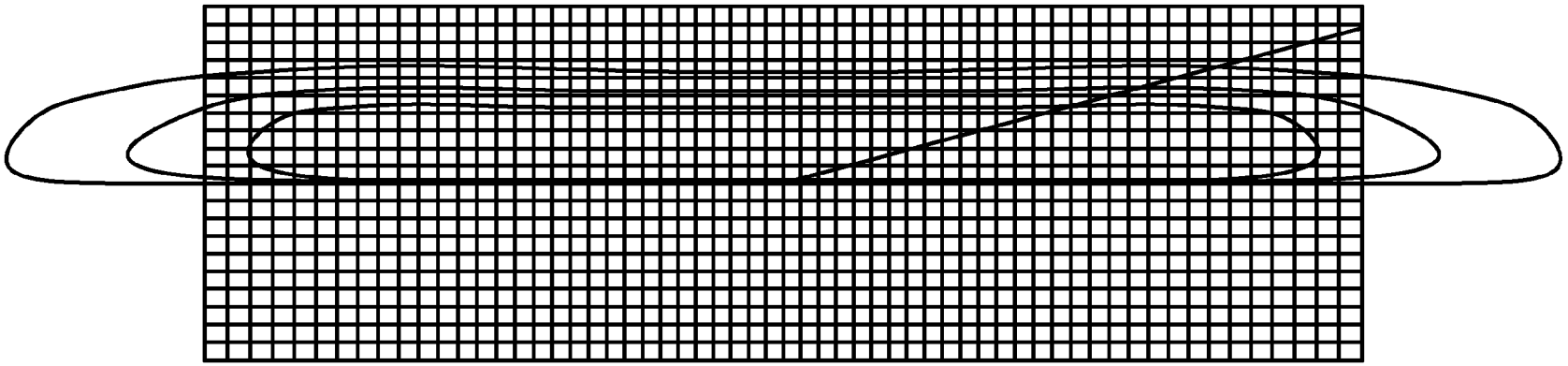
FIG. 23 shows the shape of light areas generated by a high-beam light source spot lamp of the invention.

4. Description Concerning Light Area Formed by Low-and-High-Beam Lamps:

When the low-beam lights are required, light up the high-and-low beam light source, and the lights emitted by the light source form a section of straight light area as shown in FIG. 22 through the system. The light area has clear cut-off lines without obvious dispersion, and on the other hand, when the high beam lights are required, light up the high-and-low beam light source in the top and the high beam light source in the bottom. The lights solely emitted by the high beam light source forms the upper light area as shown in FIG. 23 through the system. The upper light area is up-down symmetrical to the individual low-beam light area as a whole in terms of shape. When the upper light area is combined with the lower light area, the high beam light area as shown in FIG. 24 comes into being.

Figure 24:
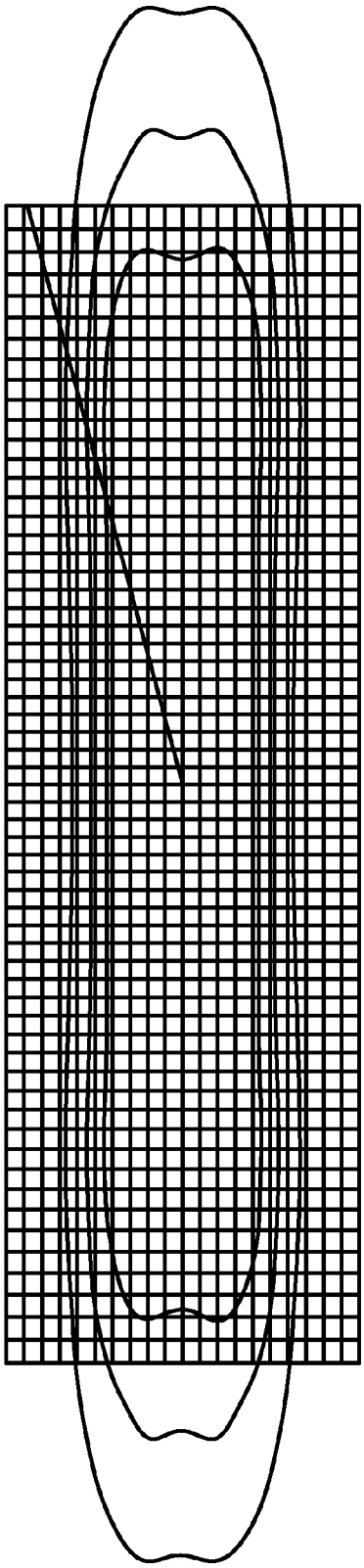
FIG. 24 shows the shape of light areas generated by a compound light source spot lamp of the invention.

5. Application Field of the System:

As being able to form a light area as shown in FIGS. 22 and 24, the system can be employed to design high-and-low beam headlamps of motorbike and automobile as well as automotive front fog lamps in addition to steering auxiliary illumination system of vehicles. Moreover, the system constitutes a standalone illuminating component and therefore, can even be used in any other purpose of illumination besides vehicle's illumination.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. An LED optical assembly for automotive low-beam headlamps, comprising:

a) a lens;

b) a lens frame;

c) a light source frame assembly; and d) an LED light source;

wherein:

the lens comprises a main lens and a plurality of reflectors;

the main lens is located in a front of the LED optical assembly and the reflectors are scattered around the main lens;

at one side of the main lens, four sets of the reflectors which are symmetrical in shape are respectively disposed at a left part and a right part thereof; and in a back of the main lens, six sets of the reflectors which are symmetrical in shape are respectively disposed at a left part and a right part thereof.

2. The assembly of claim 1, wherein a measurement value range of each point on a curved surface of the main lens at three coordinates X, Y, and Z is below:

assume a central point of the lens is an origin of the coordinates, the coordinate area along X is (5 mm, +35 mm), along Y is (−20 mm, +20 mm), and along Z is (−15 m, +15 mm).

3. The assembly of claim 1, wherein:

3 sets of the reflectors are placed on either side of a light source central point along Y in the back of the lens;

each set contains at least one reflector and those total 6 sets of reflectors are arranged in a line;

two sets of the reflectors that are the closest to the light source central point constitute primary reflectors and face towards the main lens ahead;

a distance between an inner-most border of the 2 sets of primary reflectors and a border of the light source is ranged from 0 mm to 2 mm;

2 sets of secondary reflectors are deployed respectively in the left and right adjacent to the outmost border of the 2 sets of the primary reflectors along Y and less close to the light source central point;

each of the 2 sets of the secondary reflectors in the left orientates towards lower left and upper left and in the right, lower right and upper right;

the 6 sets of reflectors are all in the shape of free-form surface;

an entire length range of each 3 sets of reflectors in either left or right along Y is 1 mm-20 mm;

each reflector set respectively makes up of 5%-80% of the length;

a size range of each reflector set along X is 1 mm-10 mm and along Z, 1 mm-10 mm;

4 sets of the primary reflectors are configured by the side of the lens in the upper left and lower left, upper right and lower right, and each set contains at least one reflector;

the primary reflector in the upper left is in relation to the secondary reflector facing towards upper left;

the primary reflector in the lower left is in relation to the secondary reflector facing towards lower left;

the primary reflector in the upper right is in relation to the secondary reflector facing towards upper right;

the primary reflector in the lower right is in relation to the secondary reflector facing towards lower right;

the surface of each reflector comprising the 4 sets of reflectors is in the shape of ellipsoid or in other similar shapes;

one focus of each ellipsoid surface falls in a radical range of 0 mm-5 mm around the light source central point and the other, a range of 0 mm-5 mm along X in front of the secondary reflector to which each ellipsoid surface refers; and the length of the long axis of each ellipsoid surface ranges between 1 mm and 35 mm and the short axis between 1 mm and 30 mm.

4. The assembly of claim 1, wherein:

the lens frame comprises an upper part and a lower part;

an internal profile of the lens frame matches with an external profile of the lens, so does a back shape of the lens frame and the light source frame assembly; and the lens frame has radiation wings attached to the outside thereof.

5. The assembly of claim 1, wherein the LED light source is an upper light source or a mixed light source comprising both upper and lower light sources, the upper light source is a high-and-low-beam light source, and the lower light source is a high beam light source.

6. The assembly of claim 5, wherein LED illuminating chips of the upper and lower light sources of the mixed light source are located in one side of a basic plate and the upper and lower light sources are situated in the side of the basic plate containing the LED illuminating chips.

7. The assembly of claim 1, wherein:

the light source frame assembly comprises a light source frame and a circuit board;

an installation chute for the LED light source is opened in the center;

a circuit board setup chute and a lead hole are disposed in the perimeter of the installation chute;

in the center of the circuit board is opened a light source positioning chute;

2 electrodes are respectively configured in the left and right of the light source positioning chute;

another 4 electrodes are situated elsewhere on the circuit board, and correspond to connect with the electrodes of the light source positioning chute.

* * * * *